US010111300B2

(12) United States Patent
Härkönen

(10) Patent No.: US 10,111,300 B2
(45) Date of Patent: Oct. 23, 2018

(54) DISPLAY DEVICE AND A METHOD FOR MANUFACTURING SUCH DEVICE

(71) Applicant: BENEQ OY, Espoo (FI)

(72) Inventor: Kari Härkönen, Espoo (FI)

(73) Assignee: BENEQ OY, Espoo (FI)

( * ) Notice: Subject to any disclaimer, the term of this patent is extended or adjusted under 35 U.S.C. 154(b) by 0 days.

(21) Appl. No.: 15/550,141

(22) PCT Filed: Mar. 4, 2016

(86) PCT No.: PCT/FI2016/050134

§ 371 (c)(1),
(2) Date: Aug. 10, 2017

(87) PCT Pub. No.: WO2016/142579

PCT Pub. Date: Sep. 15, 2016

(65) Prior Publication Data

US 2018/0077773 A1 Mar. 15, 2018

(30) Foreign Application Priority Data

Mar. 9, 2015 (FI) ..... 20155154

(51) Int. Cl.
*H05B 33/22* (2006.01)
*H05B 33/10* (2006.01)
*H05B 33/28* (2006.01)

(52) U.S. Cl.
CPC ..... *H05B 33/22* (2013.01); *H05B 33/10* (2013.01); *H05B 33/28* (2013.01)

(58) Field of Classification Search
None
See application file for complete search history.

(56) References Cited

U.S. PATENT DOCUMENTS 5,757,127 A 5/1998 Inoguchi et al.
9,226,362 B2 * 12/2015 Harkonen ..... H05B 33/10
(Continued)

FOREIGN PATENT DOCUMENTS

CN 100530676 C 8/2009
CN 202275258 U 6/2012
(Continued)

OTHER PUBLICATIONS

Written Opinion of the International Searching Authority issued by the Finnish Patent and Registration Office acting as the International Searching Authority in relation to International Application No. PCT/FI2016/050134 dated Jun. 3, 2016 (6 pages).
(Continued)

*Primary Examiner* — Ashok Patel
(74) *Attorney, Agent, or Firm* — Robert P. Michal, Esq.; Carter, DeLuca, Farrell & Schmidt, LLP

(57) ABSTRACT

An improved transparent thin film electroluminescent display including a substrate, an active layer capable of emitting a wavelength range of visible light, a viewing side surface and a narrowband reflector reflecting part of the light of the active layer back towards the viewing side surface is disclosed. Said narrowband reflector and viewing side surface are arranged on opposite sides of the active layer. A method for manufacturing an improved transparent thin film electroluminescent display including a narrowband reflector is also disclosed.

17 Claims, 18 Drawing Sheets

(56) References Cited

U.S. PATENT DOCUMENTS

| | | | | |
|---|---|---|---|---|
| 2005/0062693 | A1 | 3/2005 | Suzuki | |
| 2005/0134528 | A1 | 6/2005 | Valliath et al. | |
| 2008/0038584 | A1* | 2/2008 | Akai | H01L 51/5262 428/691 |
| 2008/0278063 | A1* | 11/2008 | Cok | B82Y 20/00 313/500 |

FOREIGN PATENT DOCUMENTS

| | | | |
|---|---|---|---|
| JP | H03222287 | A | 10/1991 |
| WO | WO-2005024501 | A1 | 3/2005 |

OTHER PUBLICATIONS

International Search Report issued by the Finnish Patent and Registration Office acting as the International Searching Authority in relation to International Application No. PCT/FI2016/050134 dated Jun. 3, 2016 (5 pages).

First Notification of Office Action issued by The State Intellectual Property Office of P.R. China in relation to Chinese Application No. 201680014137.X dated Jul. 10, 2018 (English language translation only 11 pages).

Search Report issued by the Patent Office of the People's Republic of China in relation to Chinese Application No. 201680014137X dated Jun. 29, 2018 (2 pages).

* cited by examiner

DISPLAY DEVICE AND A METHOD FOR MANUFACTURING SUCH DEVICE

CROSS REFERENCE TO RELATED APPLICATIONS

This application is a National Phase Entry under 35 USC § 371 of PCT Patent Application Serial No. PCT/FI2016/050134 filed Mar. 4, 2016, which claims priority to Finnish Patent Application No. 20155154, filed Mar. 9, 2015, the disclosure of each of these applications is expressly incorporated herein by reference in their entirety.

FIELD OF THE INVENTION

The present invention relates to a transparent display device, and particularly to a transparent display device according to the preamble of claim 1. The present invention further relates to a method for manufacturing a transparent display device, and particularly to method according to the preamble of claim 10.

BACKGROUND OF THE INVENTION

Electroluminescent (hereinafter, "EL") displays are dominantly emissive flat panel displays created for example by interposing a layer of luminescent material between two insulator layers and two conductor layers to which a controllable voltage can be applied, creating a controllable electric field over at least a portion of the luminescent material for excitation, and thus making it luminous at the location of excitation. At least the one of said conductors is at least partially transparent to allow the luminescent radiation (usually visible light) to leave the display structure for viewing purposes. Usually said layers are thin, their thickness is in the order of some 10s to 100s of nanometers (nm). Such displays are thus called Thin Film EL displays, ("TFEL" displays or "TFELs" for short).

When a voltage is applied to said conductors, the layer of EL material ("luminescent material") emits radiation in some emission wavelengths, giving rise to an emission spectrum. This spectrum can consist of one or more continuous wavelength regions where said emissions take place, separated by regions with no or only negligible emissions. For display purposes, said emission spectrum comprises at least one band of wavelengths of visible light. Said conductors are usually arranged to form a matrix of row and column electrodes, giving rise to the picture elements or pixels of the display device. Such a display is thus called a "matrix display". It is also possible to arrange the electrodes into segments of arbitrary symbols or shapes. In this case the segments can be lit independently of one another. Such a display is called a "segmented display". A TFEL display also features control electronics which is connected to the electrodes of the TFEL display. Control electronics is usually not visible to the viewer of the display, and outside the image forming display area of the TFEL display.

The light emission color of TFEL displays depends on the physical properties of the material used as a luminescent layer of the active layer. This layer is also called the "phosphor" layer in the display community. Typical materials are e.g. ZnS:Mn (zinc sulphide doped with manganese) and ZnS:Tb (zinc sulphide doped with terbium) for yellow and green emission colors, respectively. The emission ranges of these substances are rather narrow, covering only a part of the visible wavelength spectrum. A typical performance level of a commercial state-of-the-art TFEL display is a luminance of 100 nits (=100 candelas/$m^2$) or more.

Thin film electroluminescent (TFEL) technology is well known, and many important aspects of TFEL technology like the basic physics, typical materials, electrical operations, driving methods, long term stability and reliability issues and manufacturing technology of TFEL displays are common and general knowledge. In particular, AC-driven, inorganic thin film electroluminescent (TFEL) displays have reached a mature stage. In such displays, the display is driven with an alternating current (and voltage) with both substantially positive and negative driving voltage signals. Further, in such displays, luminescent layers, insulator layers and conductor layers of the display are substantially of inorganic material. A good overview of related technology is available from the book "Electroluminescent Displays" by Yoshimasa A. Ono, World Scientific Publishing Co., 1995 (ISBN 981-02-1920-0), in particular from Chapters 3, 5 and 8.

Visible light is the portion of the electromagnetic (hereinafter, "EM") spectrum to which the human eye is sensitive, causing the sense of sight or vision. The spectrum of the visible light ("visible spectrum") has a wavelength of approximately 380 nm-760 nm. Human eye interprets different wavelengths of visible spectrum of light as different colors. For example, light with wavelength of 580 nm is seen as yellow, light with wavelength of 545 nm is seen as green, and light with wavelength of 690 nm is seen as red color. In case there are many wavelengths present, the sense of vision interprets the aggregate radiation according to the well-known color theory. White light is a suitable combination of light components of different wavelengths (e.g. three components: red, green and blue).

Primary properties of any EM radiation, including visible light, are intensity, propagation direction and speed, frequency or wavelength spectrum, and polarisation. Propagation speed of the EM radiation in vacuum $c_0$=299,792,458 m/s is a fundamental constant. However, for any non-vacuum media, speed of the EM radiation is lower. Light speed in media with refractive index n is simply $c_0/n$ (speed of EM radiation in vacuum divided by refractive index of the media). Intensity of radiation (also known as power density) is the power transferred per unit area (W/$m^2$) by the EM radiation. For any viewing application, the intensity of visible light must be sufficient for the sense of sight to detect information. To convey information, information conveying light must also be detectable from the background ambient light by the sense of sight, meaning that the contrast of the information conveying light must be high enough relative to the ambient light.

An important, emerging subtype of thin film electroluminescent displays is the transparent thin film electroluminescent display, denoted also as "TASEL" or "TASEL display" for brevity. These displays are usually inorganic, AC-driven displays, but other types such as DC-driven displays or organic light emitting displays (OLED) are also possible. Transparent TFEL displays possess the significant advantage of allowing the viewer (or user) of the display to access simultaneously both the information shown on the display and information or events which are present or take place behind the display. Vehicle dashboard meters (e.g. tachometer and speedometer), neonatal intensive care unit displays and display cabinets for luxury goods with digital signage are examples of applications where it is very advantageous to see behind the display device and through the display device so that virtually nothing is obstructed from the view and maximal information is conveyed also from behind the display to the viewer. Additional information on prior art transparent TFEL technology is set forth for example in a public white paper by Abileah et al., "Transparent Electroluminescent (EL) Displays", published by Planar Systems, Inc. (2008).

Inorganic, thin film electroluminescent (TFEL) technology is especially well suitable for transparent display applications as it provides a light emitting display with potentially very high transparency with photopic transmission (as defined later) values of being higher than 50%. Consequently, unless otherwise indicated, the word "transparent" in the present application means a structure that passes light in the visible spectrum so that the photopic transmission of the structure, and in particular, the TASEL, is above 30%, more preferably above 40% and most preferably above 50%.

The main difference between transparent and conventional TFEL displays is that the opaque metal electrode material (typically aluminium) is replaced by transparent electrode material (typically indium tin oxide, ITO) so that the electrodes (and naturally, other possible layers) on both sides of the luminescent layer are suitably transparent to light. Irrespective of the display type, all TFEL displays are known for excellent picture quality, rugged design and long-term reliability.

A significant drawback of the prior art transparent TFEL displays, TASELs, is their performance in bright ambient light. Naturally, the intensity of the light emitted from the EL pixels or segments must be such that the light conveying the displayed information is clearly observable in the ambient lighting conditions by the sense of sight (also called "eyesight"). The ambient lighting conditions are unfortunately more difficult to control with TASELs than with more traditional, non-transparent TFEL displays where the completely opaque backside of the display device blocks a large portion of the ambient light.

An important measure of the display performance in ambient light is the maximum achievable contrast ratio. To make the information conveyed by the display as easy to observe as possible by the sense of sight, the contrast ratio should be as high as possible. A simple way to estimate the contrast ratio CR is given by the following equation:

$$CR=(L_{EM}+L_{AM})/L_{AM},$$

where $L_{EM}$=Luminance of a display pixel or display segment when pixel/segment is active (in a luminance state), and $L_{AM}$=Luminance of a pixel or segment originating from ambient light (pixel or segment is in a non-luminance state).

From the equation above it is easy to see that anything that decreases $L_{AM}$ and increases $L_{EM}$ would improve the contrast ratio and consequently improve display's ability to convey information for the viewer.

Prior art approaches for increasing contrast ratio CR include the idea of simply increasing $L_{EM}$, and in practical terms this can be achieved e.g. by driving the display with more power. However, there is an upper limit to the power imposed by physical characteristics of the display device. Further, power consumption must usually be minimized in any electrical appliance, especially if the appliance is portable and operated mostly or solely under battery power. As already discussed, decreasing ambient light with prior art methods in transparent displays has been challenging especially in outdoor conditions where, during daytime, sunshine creates a very strong ambient luminance from the display (ambient luminance means the light intensity reflected from or passed through the display as perceived by human eye falling upon the display viewing side surface side or backside surface from ambient light sources such as Sun, indoor lighting or car headlights).

For a transparent display, another important property is the transmission of light through the display, best characterized by a photopic transmission coefficient T, of the display over the whole visible light range as perceived by human eye, originating from a standard light source.

As EM radiation (EM radiation is also called EM waves) interacts with the media differently at different frequencies (and correspondingly, wavelengths), $T_R$ (subscript R for spectral radiometric transmission) is wavelength ("λ") dependent ($T_R=T_R(\lambda)$). $T_R$ is a spectral radiometric quantity, and it indicates the ratio of the power (or a related quantity, energy) of transmitted EM wave and incident wave at some material interface or interfaces at a certain wavelength. A TASEL or other such transparent optical device is naturally one such relatively complex example of such surfaces and material interfaces. $T_R$ can be measured using a double beam spectrometer (one beam measuring the incident, the other the transmitted wave) which produces a transmission spectrum between some wavelengths $\lambda_1$ and $\Delta_2$.

To get a more realistic transmission information related to human vision, $T_R(\lambda)$ must be weighted with a photopic spectral response of a human eye $V(\lambda)$, as only wavelengths contributing to the sense of sight are relevant in display applications—power carried by the radiation outside the visible spectrum is, from the standpoint of vision, lost.

As radiation sources also exhibit a frequency (and thus, wavelength) dependent response, to further increase the accuracy of the transmission analysis related to human vision, spectrum characteristics $I(\lambda)$ of a light source should be taken into account, too. For example, it is possible to express $I(\lambda)$ as a standard CIE-D65 light source, denoted as $I(\lambda)_{D65}$, a commonly used standard illuminant defined by the International Commission on Illumination (CIE) that corresponds roughly to a midday sun in Western Europe or Northern Europe.

The combined result of $V(\lambda)$, $I(\lambda)$ and $T_R(\lambda)$ is known as the visible light transmission or photopic transmission $T_P$, measuring the brightness of an object (e.g. display) radiating according to a standard spectral response $I(\lambda)_{D65}$ as perceived by a human eye, having response $V(\lambda)$:

$$T_p = \frac{\int_0^\infty I(\lambda)_{D65} T_R(\lambda) V(\lambda) d\lambda}{\int_0^\infty I(\lambda)_{D65} V(\lambda) d\lambda}.$$

A basic requirement for transparent displays like TASELs is that the value for photopic transmission $T_P$ of the display structure is high, more than 30%, more preferably more than 40% and most preferably more than 50%, as otherwise the transparent nature of the display starts to suffer. With careful design, value of 65% or even higher for the photopic transmission $T_P$ of a TASEL is achievable. However, as already discussed, prior art transparent displays suffer from the high intensity of ambient light that the high photopic transmission of the transparent display allows to pass through, cutting down the contrast ratio, and seriously hampering the readability and usability of the transparent (e.g. TASEL) displays.

It is also possible to express the transmission of an optical element like light source or a reflector without taking into account the physiological characteristics of vision, and to take into account the special emissive characteristics of the light source. For example, for the characteristic emissivity of EL displays, $I(\lambda)_{EL}$, the electroluminescent transmission $T_{EL}$ can be defined as $$T_{EL} = \frac{\int_0^\infty I(\lambda)_{EL} T_R(\lambda) d\lambda}{\int_0^\infty I(\lambda)_{EL} d\lambda}$$

A related quantity is the electroluminescent reflectance, $R_{EL}$, defined here as $R_{EL}=1-T_{EL}-L$. This means that amount of light emitted by the EL light source (such as an EL display) not transmitted through the surface of the light source is reflected back at the surface, or lost into the optical loss mechanisms (expressed as coefficient L) of the source.

By studying the expression for $T_{EL}$ it is evident that in the numerator there is a product of two factors, $I(\lambda)_{EL}$ and $T_R(\lambda)$. If either one of these factors is zero or close to zero, the product is zero or close to zero, and the contribution to the integral is also zero or close to zero. Thus, it is possible to achieve a very small overall $T_{EL}$ with a design that transmits very little (manifested by a low values of $T_R(\lambda)$) at wavelengths where the emissivity is high (manifested by high values of $I(\lambda)_{EL}$), and transmits substantially at wavelengths where the emissivity is low.

In other words, an EL display structure can have a relatively high photopic transmission (say, 60%), leading to a rather low photopic reflectance (100%−60%=40%, assuming small or negligible losses). Such a structure is substantially transparent to the sense of sight. However, at the same time, its electroluminescent transmission can be very low (in the order of 5%-35%), leading to a very high electroluminescent reflectance (65%-95%, again assuming zero or otherwise negligible losses). Such a structure is almost entirely non-transparent to electroluminescent light. The difference in photopic and electroluminescent values is created mostly by the different spectral characteristics of the light sources in $T_P$ and $T_{EL}$ and wavelength-specific response of the structure. If such a structure substantially reflects light on a narrow band of wavelengths, it is often called a narrowband reflector ("NBR" for short).

Depending on the application, values for suitable electroluminescent transmission of the narrowband reflector of the transparent thin film electroluminescent display of the present invention are from 50% to 65%, from 25% to 50%, or from 0.1% to 25% for the emission spectrum emitted by the active layer of the display. Assuming small losses (L is approximately 0), this leads to electroluminescent reflectance ($R_{EL}=1-T_{EL}$) of from 35% to 50%, from 50% to 75%, or from 75% to 99.9% for the emission spectrum emitted by the active layer of the display, respectively.

In prior art, the problem of lack of contrast in bright ambient light has usually been solved with a specific backside photochromic layer that darkens the rear of the display element, as provided for example in US patent publication U.S. Pat. No. 5,757,127. Naturally, driving and control circuitry must be provided for the darkening layer for excitation and detection of bright ambient light, making such approach complex and requiring external energy. The approach is also based on absorption of light, not on the reflection of light. Thus, light emitted by the display towards the backside is lost from viewing purposes, and thus part of the energy driving the display is wasted.

Prior art also shows display devices where narrowband reflectors are used. For example WO2005/064383 uses a narrow band reflector for separating two stacked displays. This document does not present anything about the lack of display's contrast in bright ambient light as the overall display device is completely non-transparent and therefore not prone to ambient light passing through the overall structure.

BRIEF DESCRIPTION OF THE INVENTION

An object of the present invention is to provide a transparent display and a method for manufacturing such a transparent display to overcome or at least alleviate the above mentioned prior art disadvantages. The objects of the invention are achieved by a transparent display device which is characterized by what is stated in the characterizing portion of independent claim 1. The objects of the present invention are further achieved by a method which is characterized by what is stated in the characterizing portion of independent claim 10.

The preferred embodiments of the invention are disclosed in the dependent claims.

The present invention is based on the idea of providing at least one narrowband reflector (hereinafter, "NBR") to a transparent display. It has been surprisingly found out that an NBR can make a major improvement to the contrast ratio of a transparent display without a substantial negative impact on the visibility through the display as perceived by the viewer of the display. With "narrowband" the present application means that only a subset, one or more sub-bands of the visible spectrum is reflected by the NBR. Thin film optical reflectors with narrowband characteristics are, as such, well known, and many important aspects of that technology like basic physics, typical materials, optical design concepts and design software tools and manufacturing technology are common and general knowledge, e.g. from the book "Thin Film Optical Filters", by H. A. McLeod, published by Institute of Physics Publishing, ISBN 0 7503 0688 2, Chapter 5.2.

A transparent display has two sides, first side, the viewing side, and a second side, the backside. Display surfaces are called the viewing side surface at the viewing side, and the backside surface at the backside, respectively. The viewer of the display observes the display from the viewing side, through the viewing side surface. Even though the display is transparent, in most cases it makes sense to observe the display from the first, viewing side only, as the information displayed on the display appears as a mirror image on the second side, on the backside surface of the display, making it difficult to comprehend. According to the present invention, the viewing side surface and the one or more narrowband reflectors are placed on the opposite sides of the active layer. Said active layer contains at least one luminescent layer of the display. An active layer can also contain other layers like barrier layers (improving the lifetime and reliability of the display) and optical matching layers (improving the optical properties of the display) inside or on top of the active layer structure. There can be one or many NBRs, but relevant to the current invention is that they are positioned on the other side of the active layer than the viewing side surface.

Due to the narrowband operation of the NBR, the NBR still has a suitably high photopic transmission so that the overall TASEL structure incorporating one or more NBRs has a photopic transmission $T_P$ of more than 30%, more preferably more than 40% and most preferably more than 50%, rendering the TASEL substantially transparent for the purposes of human vision.

As the active layer of a prior art TASEL emits approximately half (~50%) of its radiated power (=power that is radiated to the outside of the display structure) towards the viewing side surface, and the rest towards the backside surface, and as the NBR is adapted to considerably reflect the light back towards the viewing side surface at the emissive wavelengths, luminance of the light emitted by the active layer at the viewing side surface is increased when compared to a prior art display with no NBR preset in the structure. Similarly, the luminance of the ambient light over the visible spectrum towards the viewer on the viewing side surface is decreased since part of the ambient light (in particular ambient light in the substantially emissive wavelengths of the active layer) is considerably reflected by the NBR towards the backside surface. As the emitted luminance is thus increased and luminance due to ambient light is decreased, contrast ratio of the transparent display is increased and enhanced considerably, leading to overall improvement of TASEL's readability and usability.

The present invention is further based on the method of manufacturing an advantageous transparent thin film electroluminescent display having a viewing side surface, an active layer and a narrowband reflector, wherein the method comprises a step of arranging a narrowband reflector and a viewing side surface on the opposite sides of the active layer.

BRIEF DESCRIPTION OF THE DRAWINGS

In the following the invention will be described in greater detail by means of preferred embodiments with reference to the accompanying FIGS. 1-18. The drawings in the Figures are mostly schematic, and the dimensions are not in scale. In particular, the thickness of the various thin film layers of the Figures is exaggerated with regard to the other dimensions of the device to improve readability.

In the Figures,

FIGS. 13A to 15B show examples of NBR's optical properties where;

FIG. 13A shows optical properties of an NBR with a very high electroluminescent reflectance for yellow EL light;

FIG. 15B shows optical properties of a one-sided NBR for green TASEL display;

Finally.

Figure 1A:
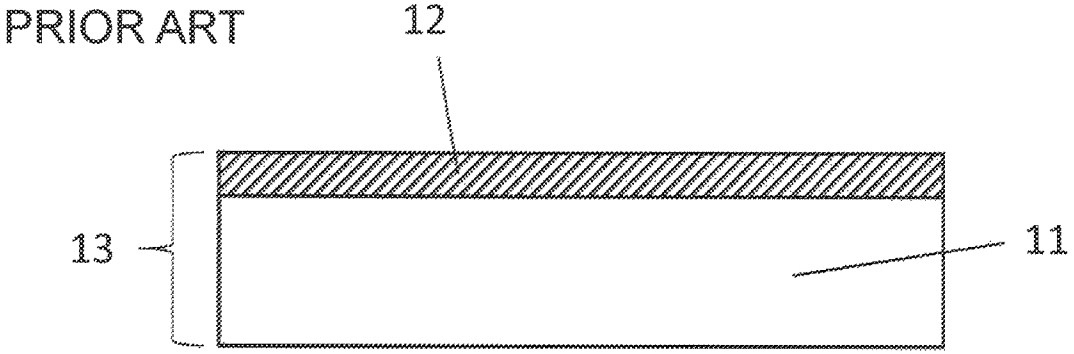
FIGS. 1A and 1B are a schematic representations of the structure of a prior art transparent TFEL displays.

It should be noted that in FIGS. 12A-18, the emission spectra is shown in a relational scale with a maximum emission value normalized to 1 (100%).

DETAILED DESCRIPTION OF THE INVENTION

In the following description, for the purposes of clear explanation, a number of specific details are set forth in order to provide a thorough understanding of the invention. It is apparent to one skilled in the art that embodiments of the invention may, however, be practiced without one or more of these specific details or with some equivalent arrangement. Furthermore, the features of the specific embodiments described below may be combined in any suitable manner.

A "substrate" in the context of the present application is the material providing the main, rigid structure of the display. Such substrate materials may include soda lime, borosilicate glass, or any other material with sufficient transparency. In some embodiments, substrates other than glass materials may be suitable, such as polymer substrates which may provide greater mechanical durability or flexibility than glass. The photopic transmission of suitable substrates is preferably greater than 60%. In some embodiments, the transmission of a substrate may be greater than 80% or even greater than 90%. Substrate thickness may be in the range of 0.05 mm-5 mm or more. In some embodiments, the thickness of the substrate may be in the range of 0.3 mm-3 mm or 0.7 mm-1.2 mm, and a suitable thickness is about 1.1 mm.

Further, a variety of different thin film materials may be used for the TFEL display structure and for the optical structure of the NBR. Materials that are generally suitable for transparent TFEL display manufacturing or for manufacturing of optical narrowband reflectors are advantageous. ZnS:Mn luminescent material is preferred for yellow emitting TFEL displays so that luminescent layer and consequently the active layer comprise ZnS:Mn. ZnS:Tb luminescent material is preferred for green emitting TFEL displays so that luminescent layer and consequently the active layer comprise ZnS:Tb. However, the selection of materials is not limited to these luminescent materials. Other luminescent material can be used and are preferred especially if other emission colors are needed.

Insulator or dielectric materials for the TFEL display may include $Al_2O_3$, $TiO_2$, $HfO_2$, $ZrO_2$, $SiO_2$ and combinations and mixtures of these materials, or other materials, in particular oxide materials.

Transparent electrode materials for the TFEL display may include indium tin oxide (ITO), ZnO:Al, $SnO_2$ or any other conductive material with sufficient transparency. The sheet resistance (Rs) of a suitable transparent electrode is preferably less than 500 Ohm/sq. In some embodiments, the Rs may be less than 30 Ohm/sq. In other embodiments, the Rs may be less than 10 Ohm/sq.

Materials for manufacturing one or more NBRs may include $Al_2O_3$, $SiO_2$, $TiO_2$, $HfO_2$, $ZrO_2$, ZnO and ZnS, a combination of these materials, or other suitably transparent materials.

Further, in terms of manufacturing methods, many different manufacturing methods such as sputtering or evaporation methods may be used for making the TASEL structure and for making the optical structure of the NBR. Many different manufacturing methods (e.g. bonding with adhesive) may also be used for integrating or combining the parts of the TASEL structure and the NBR. Methods that are generally accepted as suitable for transparent TFEL display manufacturing or for the manufacturing of optical narrowband reflectors or their integration or combining are preferred and suitable.

A preferred manufacturing method for both luminescent and insulator layers of TFEL display, and for thin films of the one or more NBRs, is the Atomic Layer Deposition method, for short, "ALD". ALD is a generally known coating method in which one or more surfaces of a substrate or other such surface are subjected to alternating surface reactions of at least a first and second gaseous (or vapour phase) precursors.

One ALD cycle is completed when the surfaces of the substrate to be coated by ALD are subjected once to all gaseous (usually two) precursors. By repeating the cycles, material layers of different thicknesses can be achieved. The ALD surface reactions are normally substantially saturated surface reactions, meaning that only one monolayer of material is formed on the surfaces of the substrate in one ALD cycle. One basic characteristic of ALD method is the excellent conformity of the surfaces reactions. This means that the ALD growth layers of material grow on all the surfaces which are subjected to the precursors, and at a substantially same thickness. This makes ALD very attractive in optical applications where even the slightest variation in material thicknesses leads to optical distortion and other such problems, and thus ALD is also a prominent method for making TFELs and related structures like NBRs and luminescent layers.

Figure 1B:
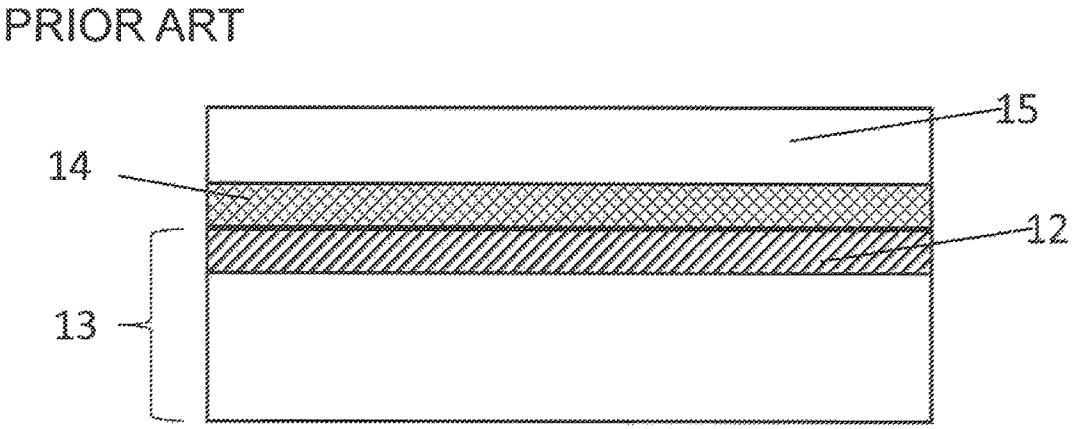

FIGS. 1A and 1B show schematic prior art structures of transparent TFEL displays in which transparent thin films and substrate components are arranged. FIG. 1A shows a basic transparent thin film display structure 13 comprising an active layer 12 on a transparent substrate 11 (e.g. glass). The purpose of the active layer 12 is to perform the display functions of image generation, and it always contains many relevant parts of the EL display, including the luminescent layer, insulator layers and electrodes/electrode layers. In FIG. 1B, thin film display structure 13 is further encapsulated with an extra transparent sheet 15 (e.g. glass) using an adhesive layer 14 (e.g. epoxy adhesive sufficiently transparent at least in the visible wavelengths). Preferably, the epoxy or other adhesive used has a refractive index value in the range 1.35-1.70. In other embodiments, the refractive index may be in a range of about 1.45 to 1.60 or in a range of about 1.48 to 1.53. Preferably, the adhesive is further a heat curable epoxy or a light curable acrylic adhesive. The thickness of the adhesive layer 14 may be in the range of 5 μm-100 μm, preferably 10 μm-50 μm.

Figure 2A:
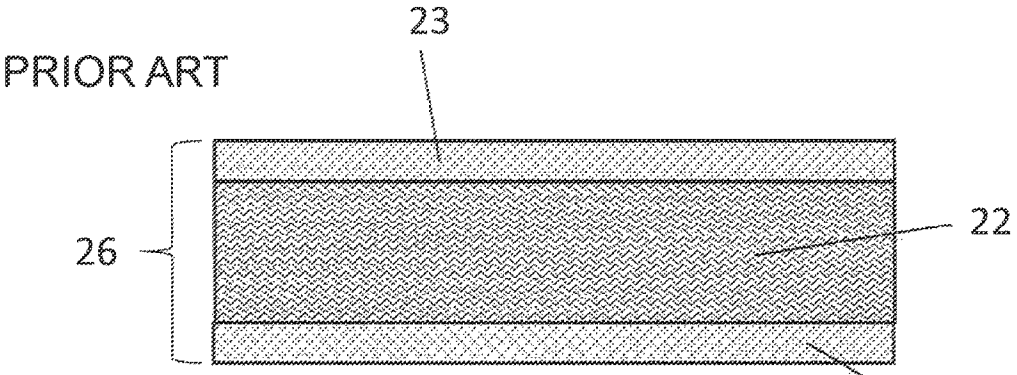
FIGS. 2A and 2B are a schematic representations of the thin film structures of a prior art TFEL display.
Figure 2B:
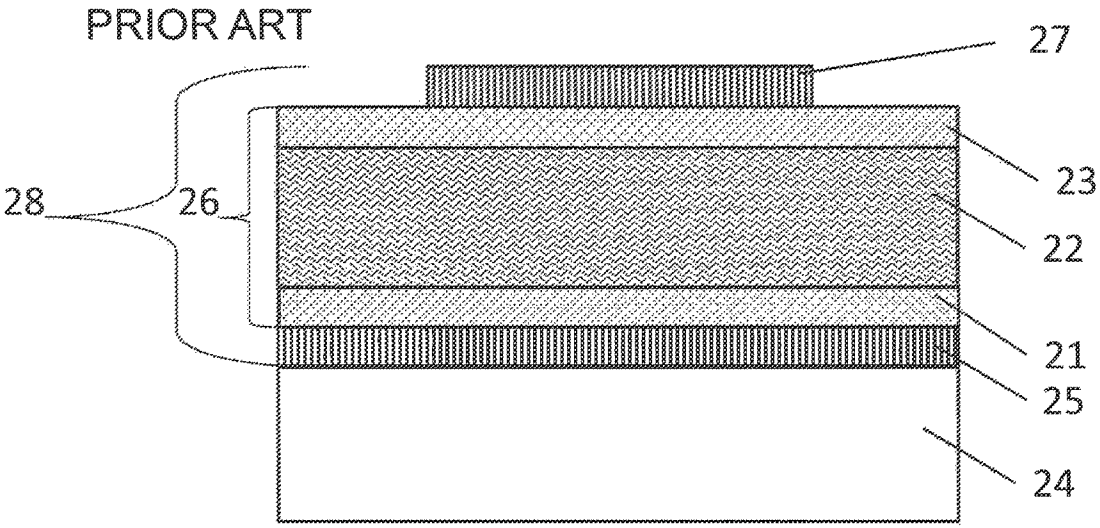

In FIG. 2A, the schematic structure of a prior art section of an active layer of a TFEL display, e.g. a TASEL display, comprises an insulator-phosphor-insulator (also called "IPI" for short, or dielectric-semiconductor-dielectric, or "DSD" for short) stack 26 where a luminescent material layer or luminescent layer 22 (also called a "phosphor layer") is situated between two insulator layers 21 and 23. In FIG. 2B, two transparent electrodes 25 and 27 are placed on the sides of the IPI structure 26. Structures 25, 26 and 27 form one example of an active layer 28 of a TFEL display. In other words, an active layer of a TFEL display can have at least one luminescent layer 22 placed between two insulating layers 21 and 23, and at least two electrodes 25 and 27 the outer sides of the said insulating layers.

It is evident for a man skilled in the art that all layers of the TFEL display can consist of different sub-layers. For example, the insulator layers can consist of two different insulating materials each, and the luminescent layer can also consist of two or more different materials that are luminescent or otherwise improve the overall operation of the luminescent layer.

Electrodes may be patterned to form rows and columns of the TFEL display for a matrix type of display, or segments, symbols or shapes for a segmented type of display. In FIG. 2B, the active layer 28 is arranged directly over a substrate 24 e.g. by depositing the different layers of active layer 28 on the substrate 24. An active layer can also contain other layers like barrier layers (improving the lifetime and reliability of the display) and optical matching layers (improving the optical properties of the display for example to couple more light out of the active layer) inside or on top or at the bottom of the active layer structure (other such layers not shown in FIG. 2A or 2B). In other words, the electrodes do not have to be placed as the outermost layers of the active layer structure.

It should be noted that small perforations (holes penetrating through the electrode) or thin-outs (small dimples not penetrating through the electrode but making it thinner and thus easier for light to penetrate) can also be arranged to the electrodes to enable light pass through the electrodes even better (perforations not shown), further increasing the quality of the display functions.

Figure 3A:
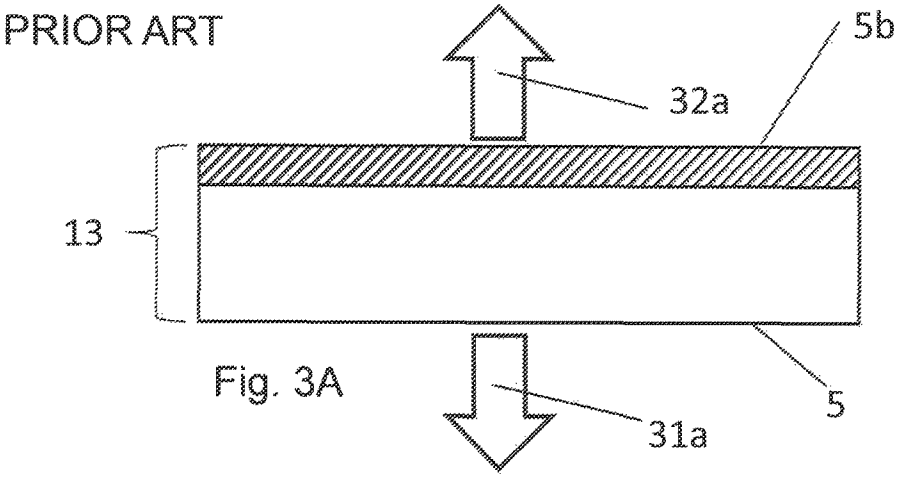
FIGS. 3A and 3B show the light emission of a prior art transparent TFEL displays.

A simple prior art transparent thin film display structure shown in FIG. 3A is an emissive display as shown in FIG.

Figure 3B:
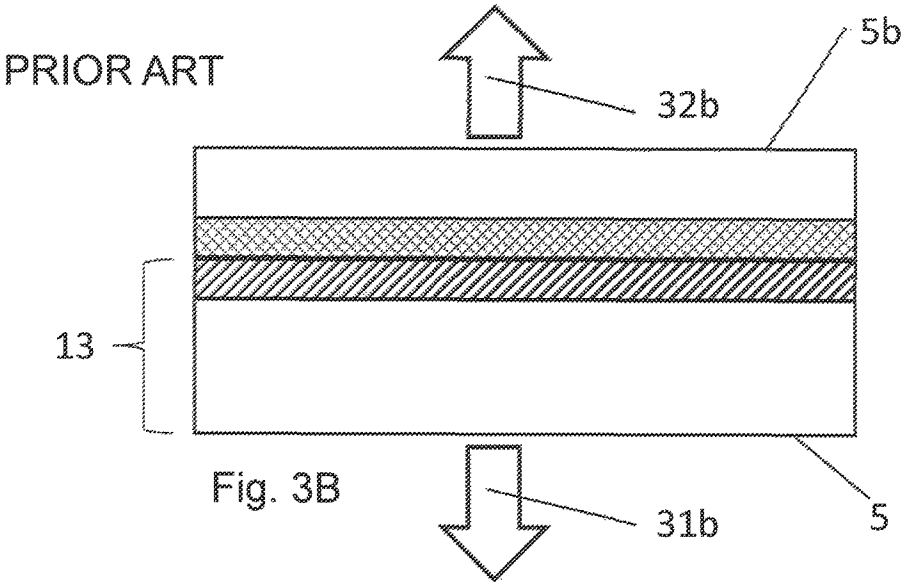

1A, and light is emitted in both directions (away from the viewing side in the general direction 31*a* and away from the backside in the general direction 32*a*) of the display as both electrodes are arranged to be transparent. Thus, light exits the display towards the viewer 7 through a viewing side surface 5. Correspondingly, the transparent TFEL display structure shown in FIG. 3B is an emissive display as shown in FIG. 1B, and light is emitted in both directions 31*b* and 32*b* of the display. Also here light exits the display towards the viewer through a viewing side surface 5. The backside surface is denoted with 5*b* in FIGS. 3A and 3B. Through the backside surface 5*b*, light exits the display away from the viewer.

Figure 4A:
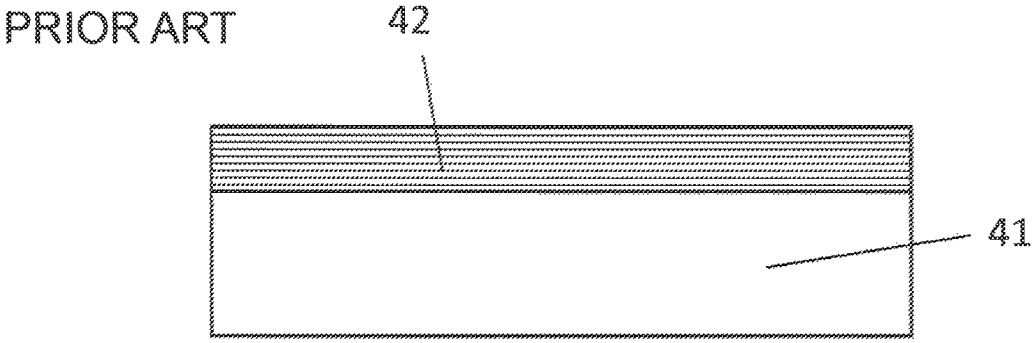
FIGS. 4A and 4B are schematic representations of a one-sided and a two-sided prior art narrowband reflectors (NBR), respectively, arranged on a transparent reflector substrate.
Figure 4B:
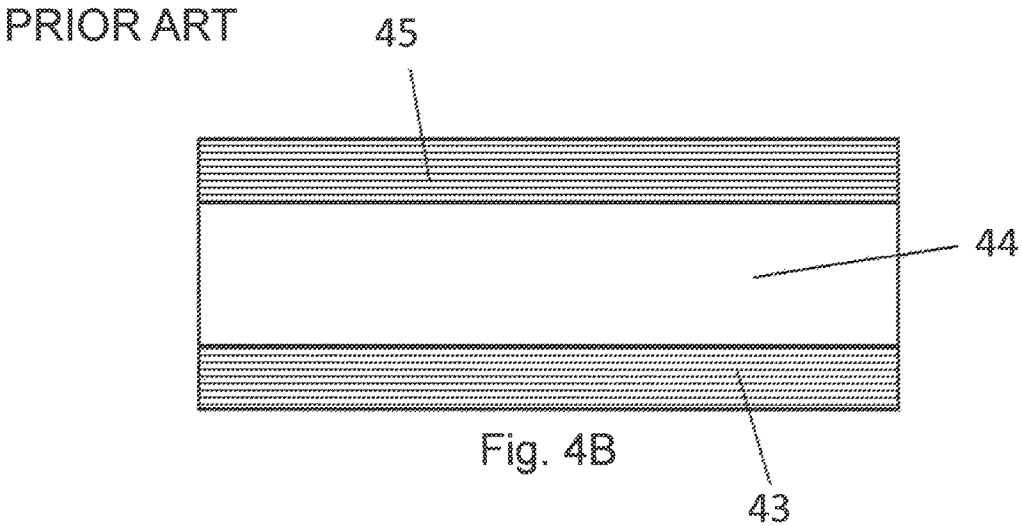

FIG. 4A shows how a prior art one-sided narrowband reflector (=NBR) can be formed with an optically designed thin film structure 42 on transparent substrate 41 (e.g. glass). In FIG. 4B, a two sided NBR is shown. Therein, optically designed thin film structures 43 and 45 are arranged on both sides of a transparent substrate 44.

Figure 5:
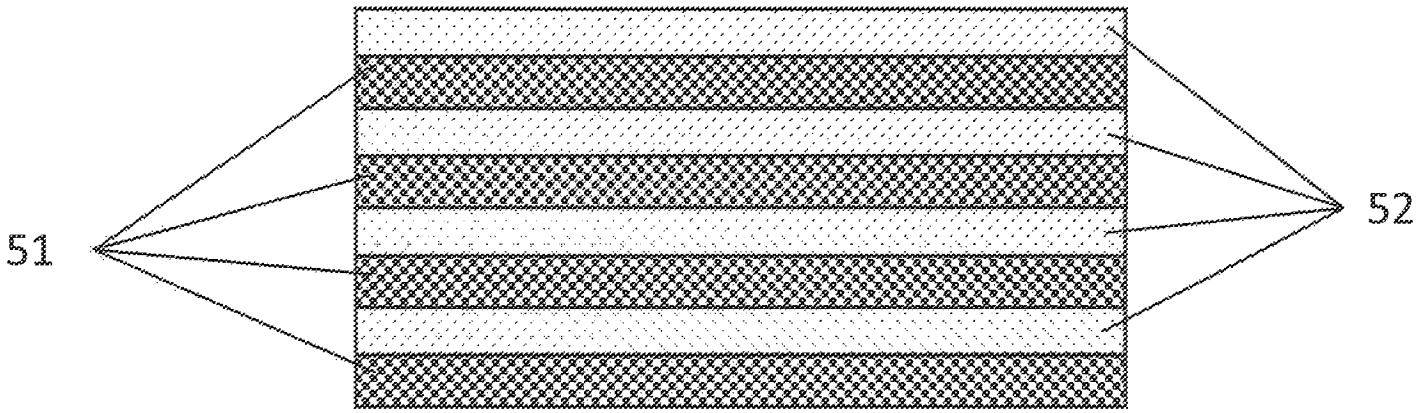
PRIOR ART Fig. 5
FIG. 5 is a schematic representation of a portion of the thin film structure of a prior art narrowband reflector (NBR) using alternating low and high refractive index materials.

FIG. 5 shows schematically in more detail how a portion of a prior art narrowband reflector (=NBR) is constructed. A typical thin film structure of an NBR includes at least one, but typically several low refractive index material layers 51 and at least one, but typically several high refractive index material layers 52 on top of each other.

In general, the narrowband reflector comprises at least one layer of high refractive index material, and at least one layer of low refractive index material. In the present application, "high" and "low" are relative terms, "high" refractive index material must have a higher refractive index than the "low" refractive index material, but their absolute values are not specific. As is evident for a man skilled in the art, refractive index is also slightly wavelength dependent. For example, aluminium oxide ($Al_2O_3$) has refractive index of approximately 1.64 in the visible wavelength range, and the value 1.64 is a typical example value for a low refractive index material. Thus, in this case, the low refractive index material comprises aluminium. By the same token, titanium dioxide ($TiO_2$) has refractive index of approximately 2.4 in the visible wavelengths, and 2.4 is a typical example value for a high refractive index material. Therefore, in this case, the high refractive index material comprises titanium. As is also evident for a man skilled in the art, an NBR can also contain other layers for e.g. optical purposes, e.g. one or more layers of a third material with a third refractive index other than high or low refractive index. For example a material with a very low refractive index, e.g. 1.52 or lower, enables optimization of NBR's optical properties, e.g. a better matching of the NBR to its surrounding, for example free space (air). $SiO_2$ is one such third material. Each of the layers can have an independent thickness (not shown). Such a structure causes wavelength-dependent constructive or destructive interference to the light propagating through and reflecting multiple times from the NBR's dielectric layers and their interfaces, resulting in wavelength-dependent transmission and reflection. If the layers of the NBR are low loss materials, the entire NBR will be substantially a low loss structure, too. The material parameters and thicknesses of each of the layers can be chosen to fulfill reflection and transmission specifications for various wavelengths of visible light. Theory of choosing the material parameters, thicknesses and layer arrangements for a desired frequency/wavelength response of transmission and reflection are well known prior art, available e.g. from "Thin Film Optical Filters", by H. A. McLeod, published by Institute of Physics Publishing, ISBN 0 7503 0688 2, Chapter 5.2.

Figure 6:
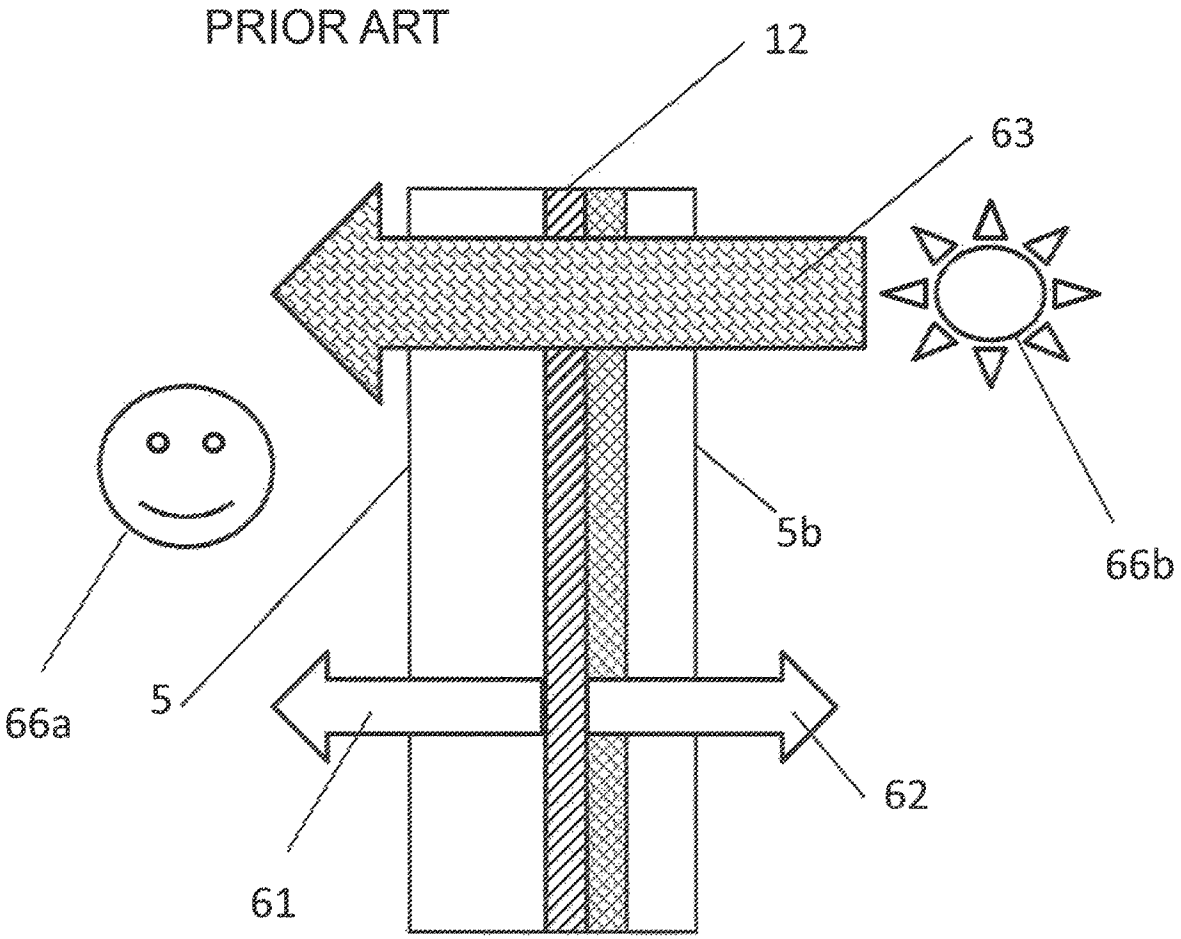
FIG. 6 shows the direction of the emitted light and ambient light in a prior art TASEL display.

FIG. 6 shows a prior art transparent TFEL display emitting light in both directions (towards and away from the viewer, through either viewing side or backside surfaces 5 or 5*b*) as defined in FIG. 3B. Depending on the exact design of the TFEL display, electroluminescent light available from the active layer 12 is either viewing side light 61 or backside light 62. The light intensities of 61 and 62 depend somewhat on the design of the transparent TFEL display, but often, in the prior art transparent displays, intensities of lights 61 and 62 are approximately equal. Thus, from the standpoint of viewing, in the absence of anything reflective on the backside, approximately half of the light emitted by the display's outer surfaces 5 and 5*b* is lost. The other important light component visible for the viewer in practical use of the display is the ambient light 63 that passes through the transparent display. Viewer of the display is denoted with 66*a* at the side of the viewing side surface 5, and ambient light source denoted with 66*b* at the side of the backside surface 5*b*.

Figure 7:
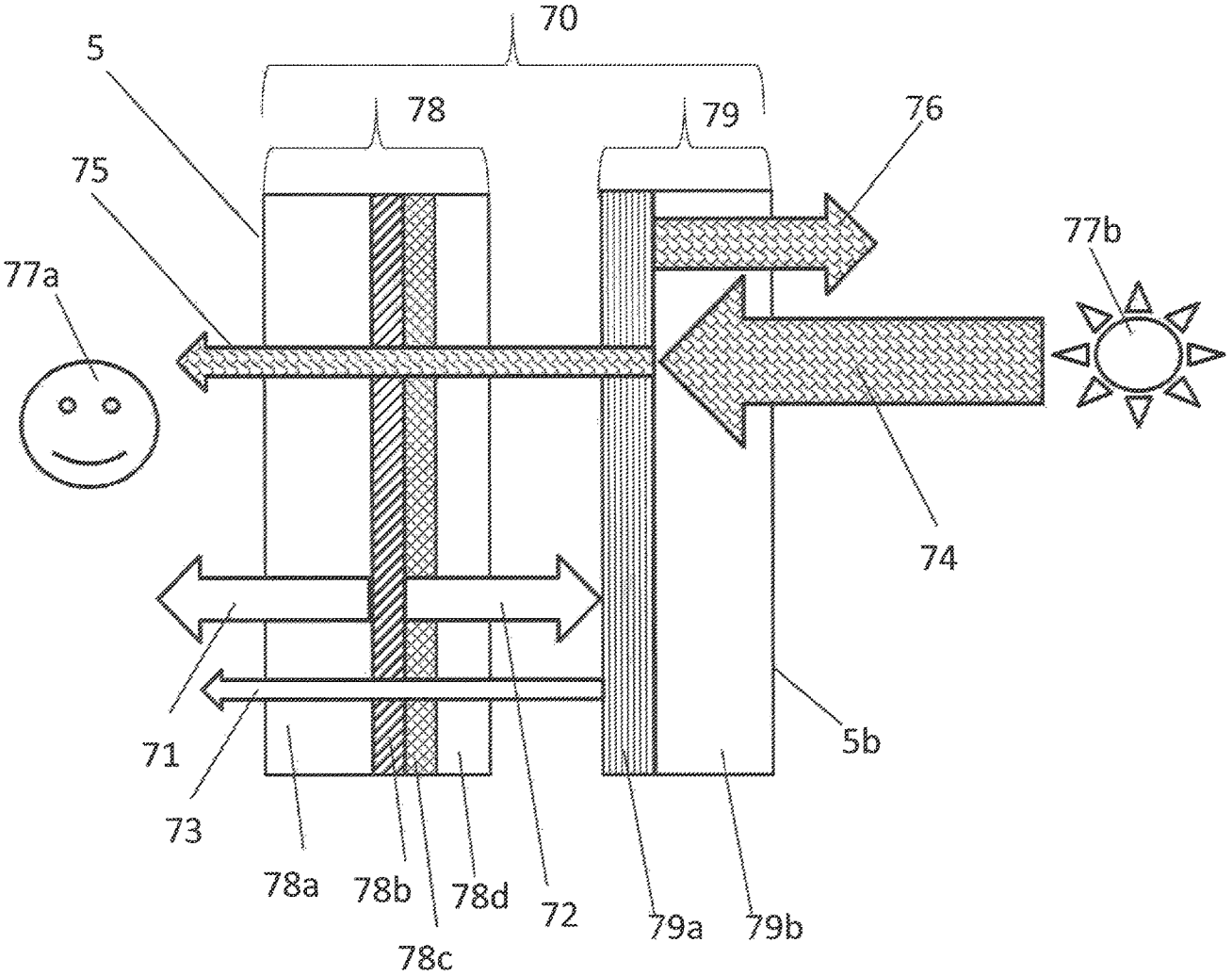
FIG. 7 shows the directions of emitted light and ambient light in a display according to an embodiment of the present invention.

According to an embodiment of the present invention, FIG. 7 illustrates how a narrowband reflector (NBR) 79*a* can be positioned behind the active layer relative to the viewer 77*a* in a TASEL 70. In structural terms, the viewing side surface 5 and the NBR 79*a* lie on the opposite sides of the active layer 78*b*, said active layer 78*b* comprising at least one luminescent layer (not show for clarity in FIG. 7). Active layer 78*b* is grown on a substrate 78*a* and optically bonded with an adhesive layer 78*c* to a transparent sheet 78*d* to form an encapsulated TASEL subunit 78.

Light emitted by the active layer 78*b* is split into two components, viewing surface light 71 and back surface light 72. Back surface light 72 travels towards the NBR subunit 79 and the NBR 79*a*. Part of the back surface light 72 is reflected from the NBR 79*a* back towards the viewing surface as reflected viewing surface light 73. This reflected viewing surface light 73 contributes to the intensity of the viewing surface light 71. Thus, the display's information conveying light observable to the viewer 77*a* of the display becomes brighter. At the same time, part of the ambient light 74 from some ambient light source 77*b* (like the sun, office lighting, car head lights or some other such ambient light source) entering the transparent display through the backside surface 5*b* is reflected by the NBR 79*a* and becomes reflected ambient light 76 leaving the TASEL 70 through the backside surface 5*b*. Consequently, the overall intensity of the transmitted ambient light 75 first passing the TASEL 70 and finally reaching the viewing side surface 5 and the viewer 77*a* decreases. As the luminance of the emitted light of the active layer is increased (contributions from both luminances of viewing surface light 71 and reflected viewing surface light 73), and the luminance of the transmitted ambient light 75 is decreased at the viewing side surface 5, the viewer 77*a* observes an increased contrast and contrast ratio of the display, improving the readability and usability of the transparent display. The encapsulated TASEL subunit 78 and NBR subunit 79 are separated in FIG. 7 for clarity. Optically and structurally an air gap between these two parts is not advantageous and should be avoided e.g. by suitable bonding means, e.g. by adhesives creating another adhesive layer (not shown) Into the TASEL 70.

As indicated in FIG. 7, it is advantageous to cover the entire surface area of the TASEL 70 with the NBR 79*a* for uniform performance in different lighting situations (FIG. 7 shows only vertical dimension of the surface area).

Figure 8:
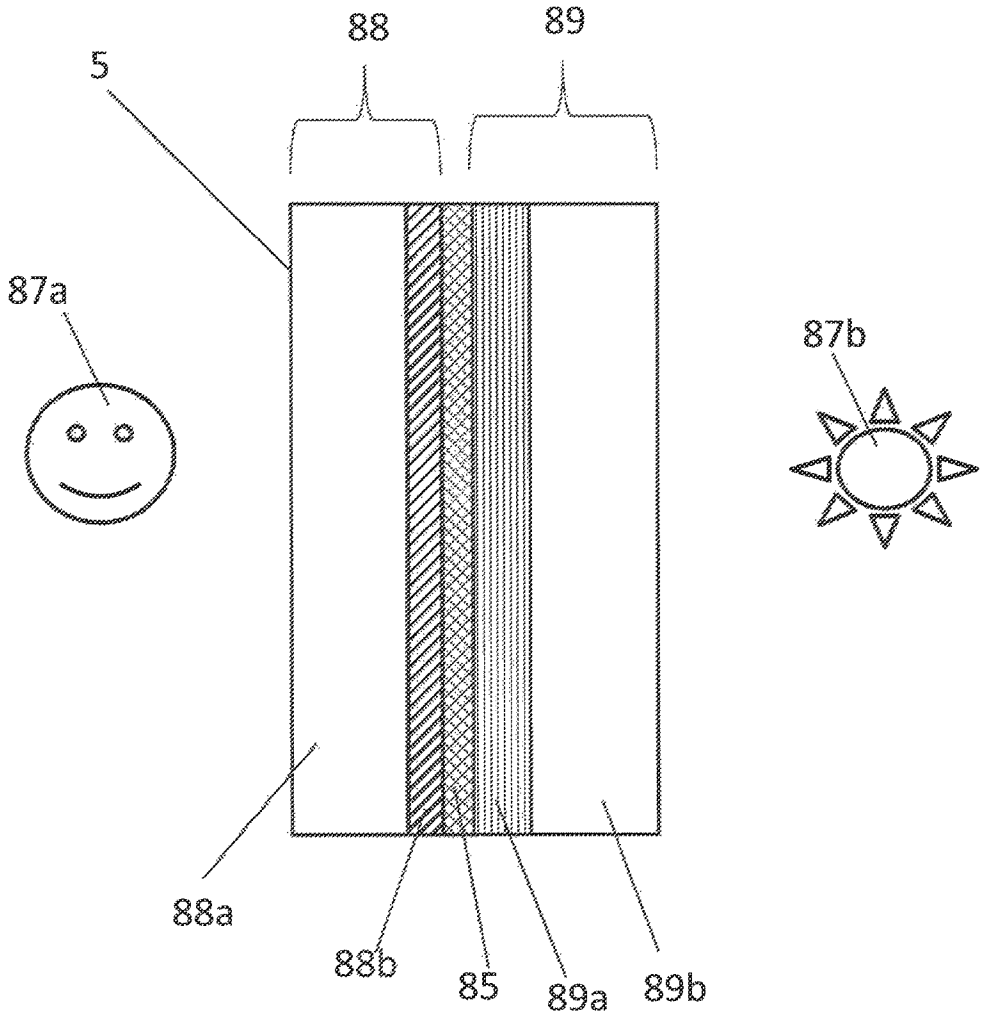
FIG. 8 shows an example of a TASEL according to an embodiment where an NBR on a separate substrate is optically bonded with an adhesive layer to the active layer of a TASEL.

An example of a TASEL display according to an embodiment of the present invention is shown in FIG. 8. NBR subunit 89 comprising an NBR 89*a* arranged on a separate substrate 89*b* is optically bonded using adhesive layer 85, e.g. comprising transparent epoxy or other adhesive suitably transparent in the context of the present application, to a thin film structure 88 directly, thin film structure 88 comprising a substrate 88*a* with viewing side surface 5 as the outer surface and an active layer 88*b*. In this embodiment, the NBR 89*a* is bonded to the active layer 88*b* with an adhesive of the adhesive layer 85. Viewer of the display is denoted with 87*a*, and an ambient light source with 87*b*.

Figure 9:
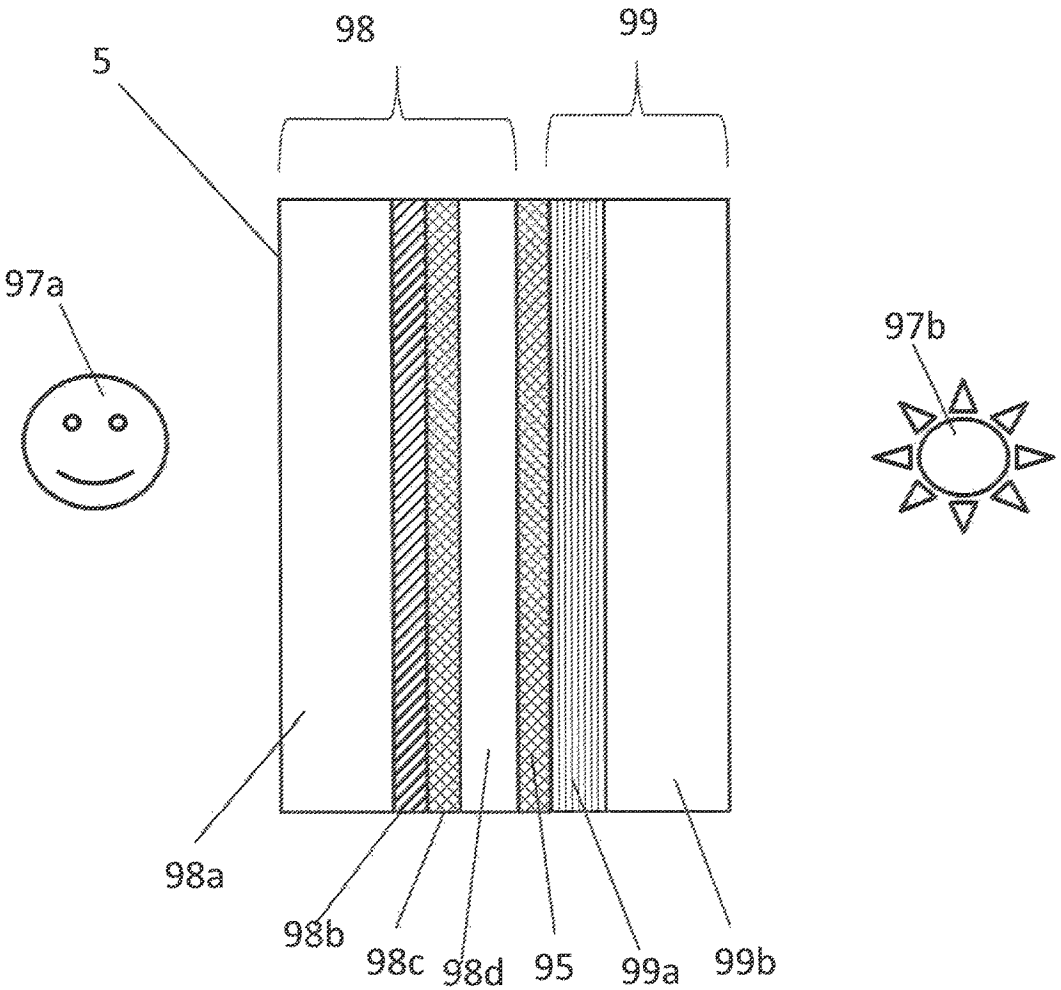
FIG. 9 shows another example of a TASEL according an embodiment where an NBR on a separate substrate is optically bonded with an adhesive layer to the encapsulated active layer of a TASEL.

Another example of a transparent TFEL display and its manufacture according to another embodiment of the present invention is shown in FIG. 9. An NBR subunit 99 comprising an NBR 99*a* and a substrate 99*b* is directly optically bonded using an adhesive layer 95 to encapsulated TASEL subunit 98 of the TASEL display. The TASEL subunit 98 comprises substrate 98*a* with viewing side surface 5, active layer 98*b*, thin film structure adhesive layer 98*c* and a transparent sheet (e.g. a glass sheet) 98*d* for encapsulation. Viewer of the display is denoted with 97*a*, and ambient light source with 97*b*.

Figure 10:
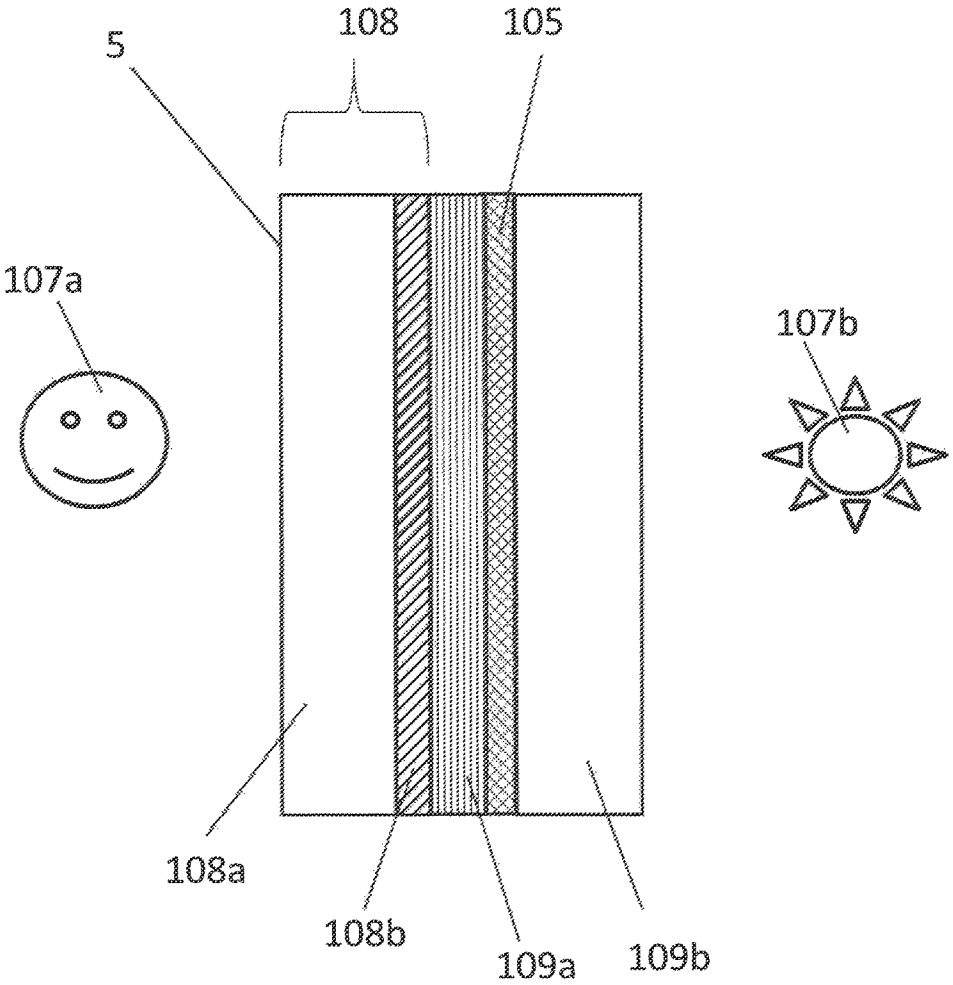
FIG. 10 shows a further example of a TASEL according to an embodiment where an NBR is integrated and arranged on top of an active layer on the same substrate, and a separate covering glass sheet is optically bonded on top of the NBR.

Another example of a transparent TFEL display according to yet another embodiment of the present invention is shown in FIG. 10. An NBR 109*a* is arranged directly on an active layer 108 of a TASEL subunit 108 comprising an active layer 108*b* on a substrate 108*a* with a viewing side surface 5. A separate transparent sheet 109*b* (e.g. a glass sheet) is optically bonded with an adhesive layer 105 on top of the NBR 109*a* for encapsulation. Viewer of the display is denoted with 107*a*, and ambient light source with 107*b*.

Figure 11:
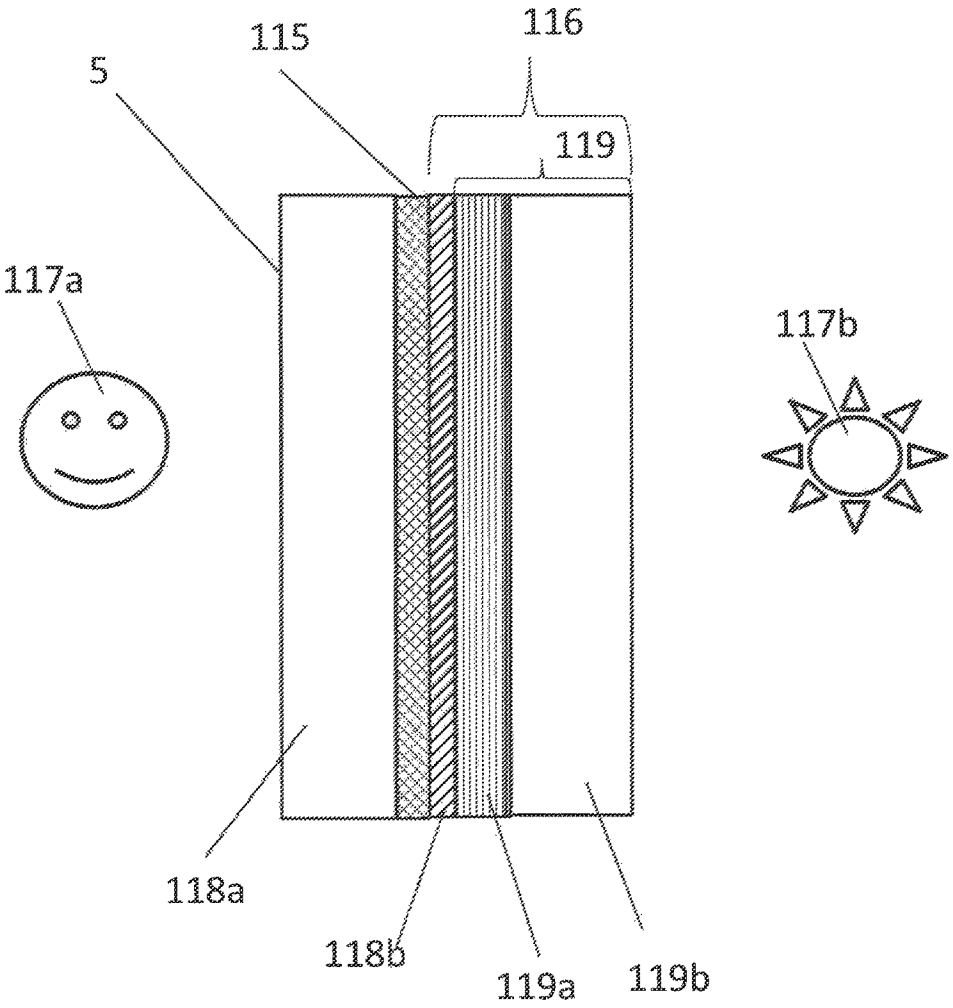
FIG. 11 shows yet another example of a TASEL according an embodiment where an NBR is integrated and arranged on the same substrate between the substrate and the active layer, and a separate covering glass sheet is optically bonded on top of the active layer.

A still further example and yet another embodiment of a TASEL display is shown in FIG. 11. An active layer 118*b* is integrated and arranged on the NBR subunit 119 comprising an NBR 119*a* on a substrate 119*b*, making a combined TASEL subunit 116 comprising both an active layer 118*b* and an NBR 119*a*. A separate transparent sheet 118*a* (e.g. a glass sheet) with viewing side surface 5 is optically bonded for encapsulation with an adhesive layer 115 on top of the TFEL thin film structure comprising an active layer 118*b*, NBR 119*a* and substrate 119*b*. Viewer of the display is denoted with 117*a*, and ambient light source with 117*b*.

Related to FIGS. 1-11, an advantageous method for manufacturing at least parts of the narrowband reflector is the ALD method, in other words, subjecting at least one of the layers of the narrowband reflector under manufacture to alternating surface reactions of at least a first and a second gaseous precursors. By the same token, an advantageous method for manufacturing the active layer is the ALD method which comprises subjecting at least one of the layers of the active layer under manufacture to alternating surface reactions of at least a first and a second gaseous precursors. Further, an advantageous method for manufacturing the luminescent layer is the ALD method: subjecting at least one of the layers of the luminescent layer under manufacture to alternating surface reactions of at least a first and a second gaseous precursors.

Figure 12A:
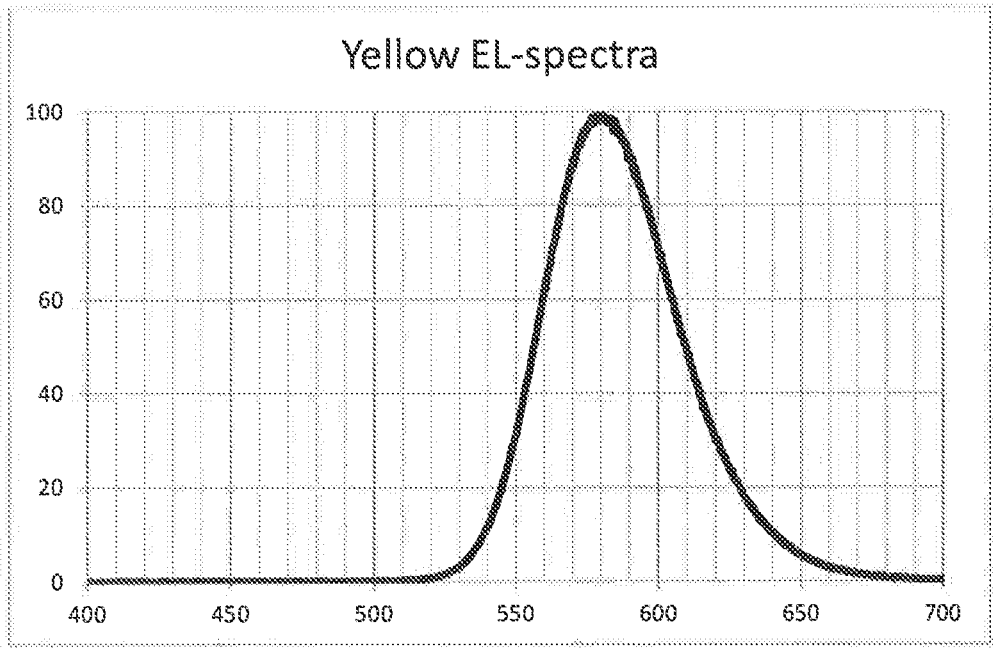
FIGS. 12A and 12B show typical emission spectra for a transparent ZnS:Mn (yellow) and ZnS:Tb (green) TFEL displays, respectively.
Figure 12B:
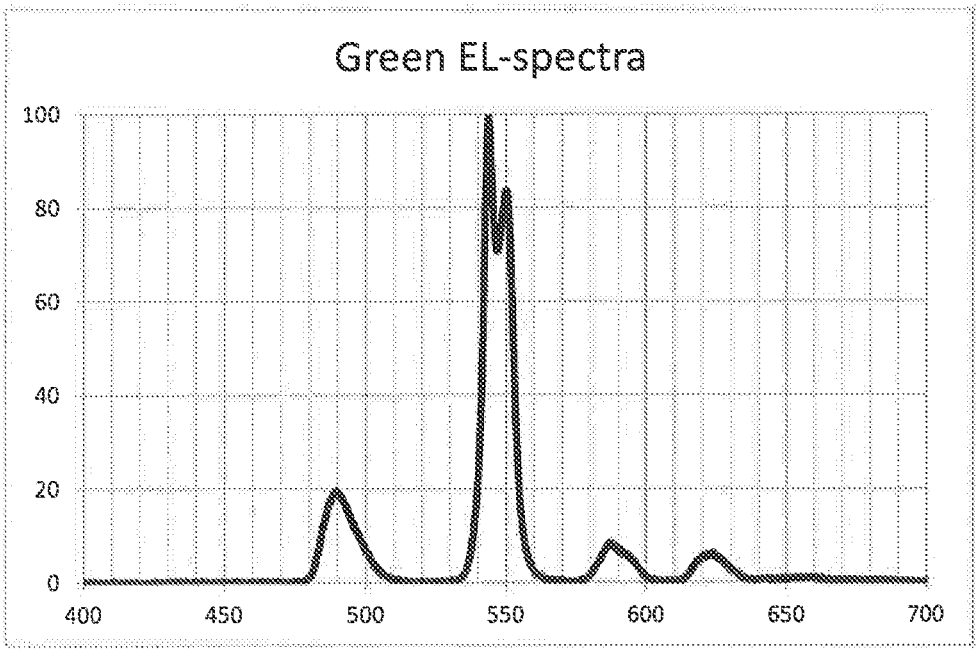

FIG. 12A and FIG. 12B show typical emission spectra $I_{EL}$ as function of wavelength for transparent ZnS:Mn (Yellow in FIG. 12A) and ZnS:Tb (Green in FIG. 12B) TFEL display. It is evident that for the majority of visible wavelengths, the display does not practically emit light, and the set of emission wavelengths comprises one range around 580 nm for the yellow luminance. For the green luminescent layer, the emission spectrum comprises mostly wavelengths in the range of 540 nm to 560 nm, with some minor emissions around 490 nm, 590 nm and 625 nm. As mentioned above, it should be noted that in FIGS. 12A-18 the emission spectra is shown in a scale with maximum emission value normalized to 1 (100%).

FIGS. 13A, 13B, 14A, 14B, 15A and 15B give examples of optical properties of NBR designs over a wavelength region 400 nm-700 nm that substantially covers the band of visible wavelengths. In each of the FIGS. 13A-17B, thin lines show the radiometric transmission of the NBR structure as function of wavelength, and thick lines denotes the luminescent reference spectra drawn in to the same graph for clarity. In FIGS. 13A-15B, the NBR in question is arranged to have a low electroluminescent transmission, and consequently, high electroluminescent reflectance.

In the following description related to FIGS. 13A-15B, L, H and S refer to optical quarter-wave thicknesses (=thickness spanning the length of one quarter (25%, ¼) of the wavelength) of the low refractive index (L), high refractive index (H) and very low refractive index materials (S), respectively, at the so-called design wavelength of the structure. Measurements are done to the NBR structure only (grown on a substrate), without e.g. active layer of the display structure.

It should be noted that in each of the FIGS. 13B-17B, the thick line denotes the reference emissive spectrum of the active layer of the display, and the thin line denotes the transmission results.

For example, assuming refractive index of n=1.64 for $Al_2O_3$, a typical L type of material with a low refractive index, thickness for a layer denoted as "0.98L" is 0.98*580 nm/1.64/4=86.6 nm, assuming a design wavelength of 580 nm. Designing the stack of H and L (and S) materials to achieve a certain wavelength response for the stack is well known prior art as discussed above. Here the NBR is arranged to have a low electroluminescent transmission, and consequently, high electroluminescent reflectance.

Figure 13A:
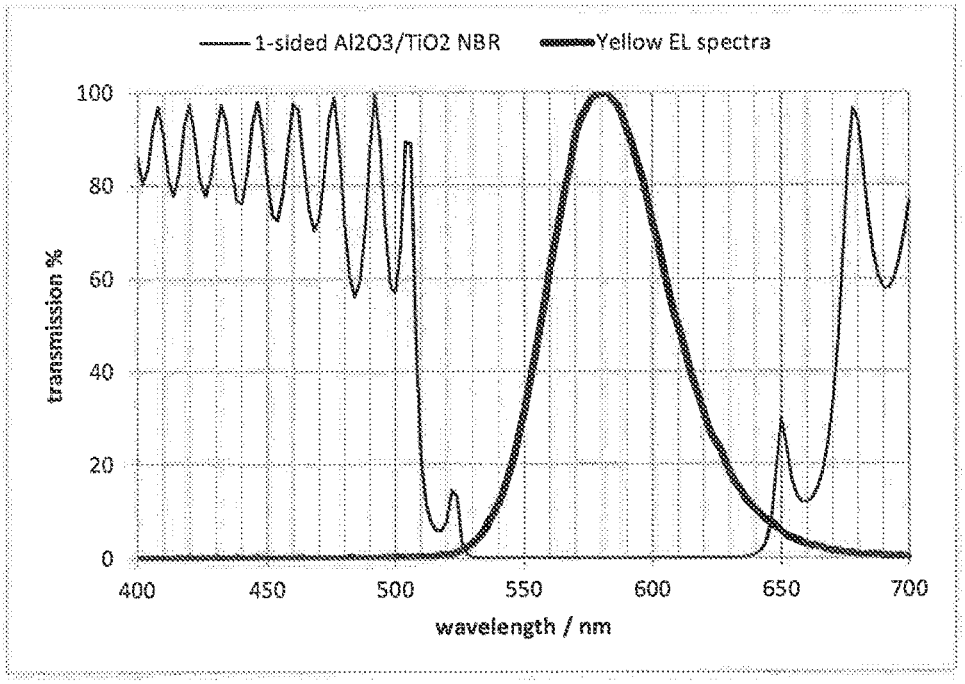

In FIG. 13A, transmission of the NBR is very low and correspondingly reflectivity is very high between wavelengths of approximately 520 nm and 640 nm. Structure related to FIG. 13A is designed for an emission spectrum of yellow luminescent layer which emits radiation substantially between wavelengths of 550 nm and 630 nm. Clearly, a NBR according to FIG. 13A reflects almost all of the light power emitted by the yellow luminescent layer of the active layer towards the viewing side surface and ultimately the viewer of the transparent display, increasing the contrast ratio and readability of the display when coupled to the TASEL structure according to the present invention. In other terms, the electroluminescent reflectance, $R_{EL}$ of the NBR is very high, and the electroluminescent transmission is very low. Similarly, ambient light is reflected considerably between wavelengths 520 nm and 640 nm as demonstrated by the low transmission values at this wavelength range, further improving the contrast ratio and readability of the display device. However, the NBR also allows light relevant to viewing behind the NBR to pass through to a large extent at a wavelength range of under 500 nm and over 650 nm, allowing the viewer to observe items and events behind the display with relative ease. As is evident from the measurements, in case of FIG. 13A, the design goal of the NBR has been to yield maximum reflectance for yellow EL light, in other words, to maximize the electroluminescent reflectance, $R_{EL}$ for yellow emission spectrum.

The structure behind result shown in FIG. 13A is "1L 1H 1L (0.98H 0.98L)7 0.98H 1L 1H 1L (1.02H 1.02L)7 1.02H 1L 1H 1S" with materials as follows: L (low refractive index material) is $Al_2O_3$, H is (high refractive index material) $TIO_2$ and S (very low refractive index material) is $SiO_2$. Substrate type was BK7 (in the optical design). Above, and in the following, notation (1.02H 1.02L)7 means, by the way of an example, that material thicknesses 1.02H and 1.02L are repeated seven times in the structure in that order. As optical properties for photopic transmission a value of T=35% is obtained, and for electroluminescent reflectance $R_{EL}$ for a yellow emission spectrum shown in FIG. 13A a very prominent value of 99% is obtained. For a low-loss structure, this indicates that the electroluminescent transmission $T_{EL}$ is only 100%-99%=1%.

Figure 13B:
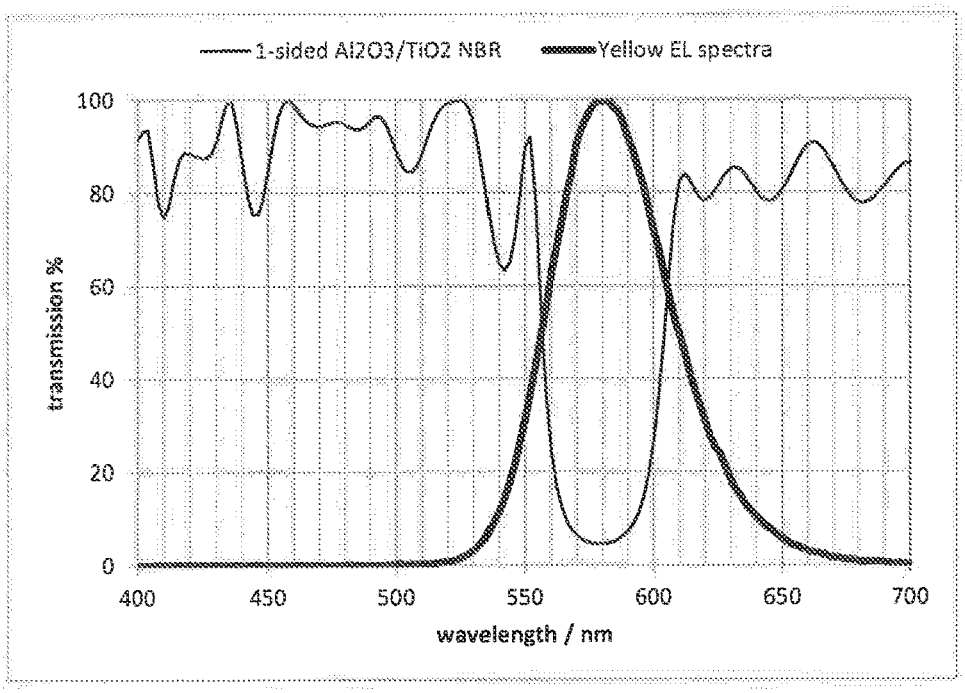
FIG. 13B shows optical properties of an a one-sided NBR with optimized reflectivity in relation to the photopic transmission of the NBR structure.

FIG. 13B shows a similar result to FIG. 13A, with the design goal of increasing the photopic transmission of the NBR without sacrificing electroluminescent reflectance $R_{EL}$ too much, evidenced by a rather narrow wavelength range with low radiometric transmission and high radiometric reflectivity of between approximately 560 nm and 600 nm. Structure related to FIG. 13B is "2.343L 1.96H 0.257L 0.211H 1.292L 1.642H 0.515L 0.161H 1.569L 1.698H 0.323L 0.481H 1.704L 1.064H 0.08L 1.451H 1.671L 0.62H 0.338L 1.92H 0.016L 1.305H 1.569L 1.424H 0.324L 0.27H 1.684L 1.449H 0.102L 1.567H 1.533L 0.241H 0.336L 1.593H 1.457L 1.151H 0.032L 1.531H 2.343S". Materials are as follows: L (low refractive index material) is $Al_2O_3$, H (high refractive index material) is $TiO_2$ and S (very low refractive index material) is $SiO_2$. Substrate type was BK7 (in the optical design). Photopic transmission of this structure is about 73%, and electroluminescent reflectance $R_{EL}$ for a yellow emission spectrum shown in FIG. 13B is about 67%.

Figure 14A:
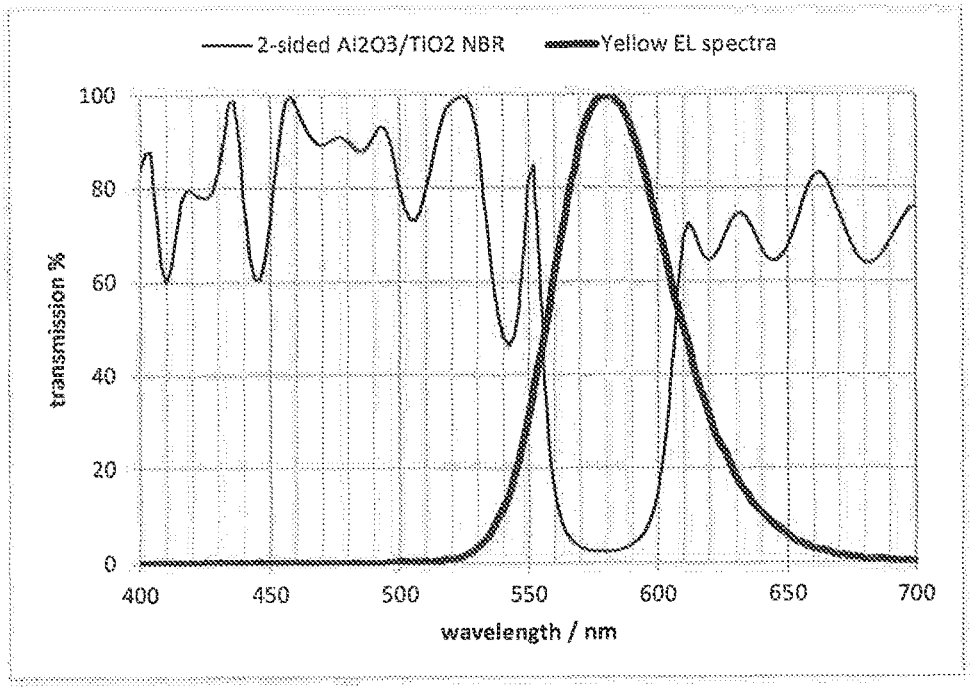
FIG. 14A shows optical properties of a two-sided NBR with optimized reflectivity in relation to the photopic transmission.

FIG. 14A shows results for a two sided NBR where high H and low L refractive index material stacks are grown symmetrically on both sides of a substrate S, with the design goal of achieving an optimized electroluminescent reflectance vs. photopic transmission as was the case in FIG. 13B. Structure related to results of FIG. 14A is (representing one half section until the substrate S): "2.343L 1.96H 0.257L 0.211H 1.292L 1.642H 0.515L 0.161H 1.569L 1.698H 0.323L 0.481H 1.704L 1.064H 0.08L 1.451H 1.671L 0.62H 0.338L 1.92H 0.016L 1.305H 1.569L 1.424H 0.324L 0.27H 1.684L 1.449H 0.102L 1.567H 1.533L 0.241H 0.336L 1.593H 1.457L 1.151H 0.032L 1.531H 2.343S". Materials: L is $Al_2O_3$, H is $TiO_2$ and S is $SiO_2$, with substrate set to BK7 (in optical design). Photopic transmission of the structure is about 65%, and electroluminescent reflectance $R_{EL}$ for a yellow emission spectrum shown in FIG. 14A is about 75%.

Figure 14B:
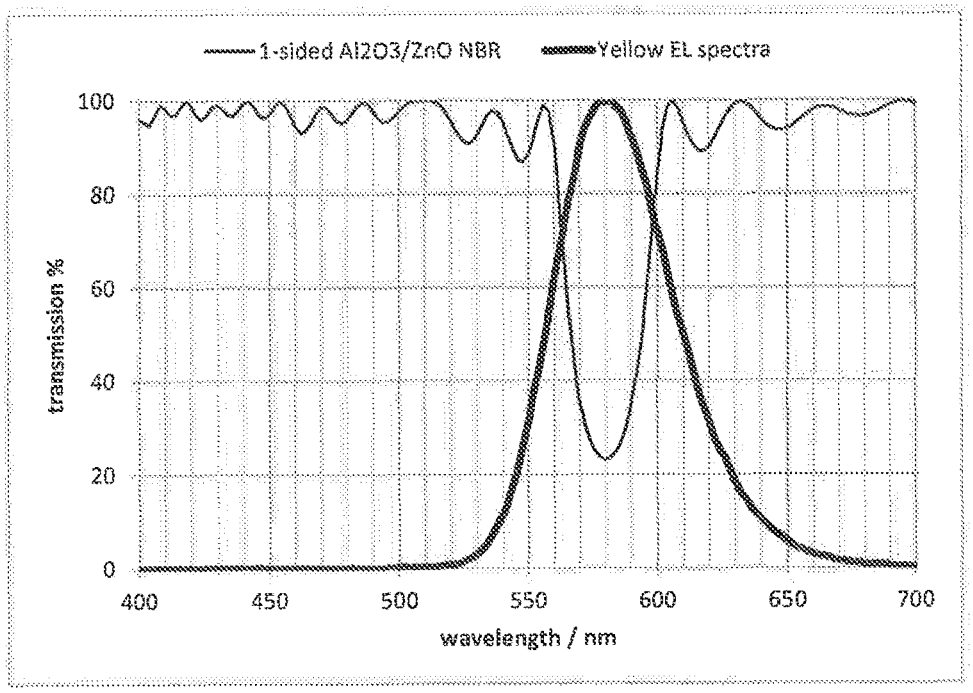
FIG. 14B shows optical properties of a one-sided NBR with maximized transmission outside the band of reflective wavelengths (also known as the "reflectivity band")

FIG. 14B shows optical results for a design that maximizes the transmission of the NBR in the wavelength regions where the yellow display is not emissive. This can lead to a higher photopic transmission of the structure. As can be seen, radiometric transmission is close to 100% outside the wavelength band where the NBR becomes reflective. Here, the low refractive index material of the NBR comprises aluminium, namely $Al_2O_3$, and the high refractive index material comprises zinc, namely ZnO. The structure related to FIG. 14B is "1.422L 1.208H 1.372L 1.086H 0.104L 1.821H 0.498L 2.891H 1.247L 1.603H 0.325L 0.861H 0.119L 2.266H 0.324L 1.621H 1.199L 1.897H 0.215L 0.427H 0.941L 1.461H 1.251L 0.239H 0.317L 1.633H 1.369L 1.078H 1.556L 0.387H 0.203L 1.415H 1.416L 0.994H 1.576L 1.819H 0.715S". Material are as follows: L (low refractive index material) is $Al_2O_3$, H (high refractive index material) is ZnO and S (very low refractive index material) is $SiO_2$, with substrate set to BK7 (in optical design). Results in FIG. 14B lead to a photopic transmission of 87%, and electroluminescent reflectance $R_{EL}$ for a yellow emission spectrum shown in FIG. 14B of 38%. An NBR related to FIG. 14B is advantageous for TASEL applications in low-light conditions as it also allows some light to pass also in the emission wavelengths.

Figure 15A:
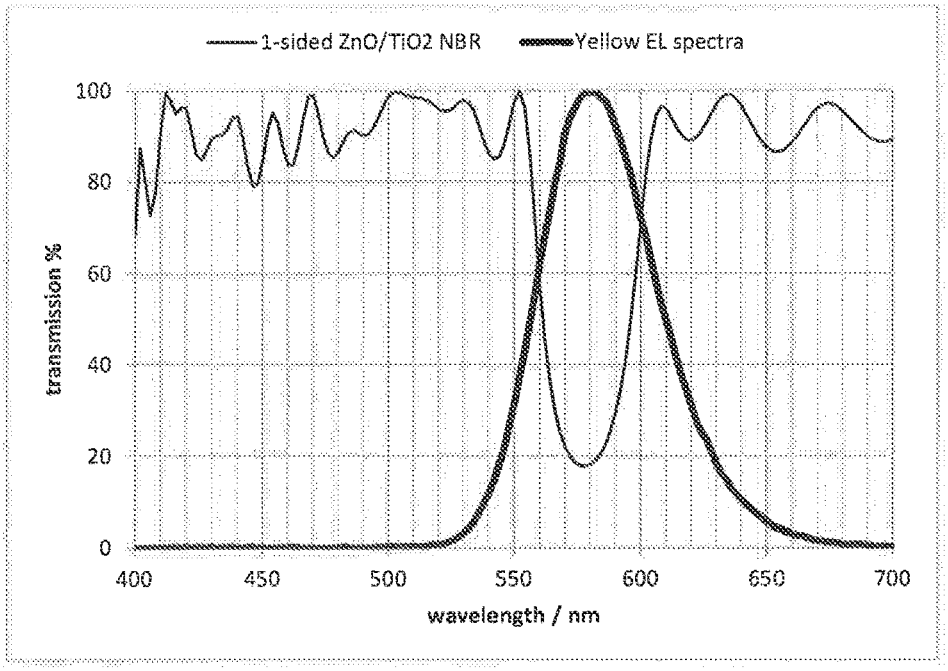
FIG. 15A shows optical properties of a one-sided NBR comprising ZnO, $TiO_2$ and $SiO_2$ materials.

FIG. 15A demonstrates results related to the utilization of zinc oxide, ZnO, as the low refractive index material in the construction of the NBR. Operation of the NBR follows what is said of structures in FIGS. 13A-14A for one-sided NBRs. Here, the low refractive index material comprises zinc, namely ZnO, and high refractive index material comprises titanium, namely $TiO_2$, illustrating the importance of relative differences in refractive indexes: In the case of FIG. 14B, ZnO performed as the high refractive index material as ZnO has a higher refractive index than $Al_2O_3$. In this case, the NBR structure is 2.334L 0.043H 1.473L 1.439H 2.442L 1.654H 2.058L 1.52H 0.813L 1.477H 2.252L 1.448H 1.311L 2.162H 1.381L 1.393H 1.52L 0.195H 0.486L 1.537H 1.35L 0.319H 1.328L 2.634H 1.651L 0.723H 0.131L 1.991H 1.039S. The materials are as follows: L (low refractive index material) is ZnO, H (high refractive index material) is $TiO_2$ and S (very low refractive index material) is $SiO_2$, with substrate set to BK7 (in optical design). The overall optical properties are: photopic transmission is about 81% and electroluminescent reflectance $R_{EL}$ for a yellow emission spectrum shown in FIG. 15A is 46%.

Figure 15B:
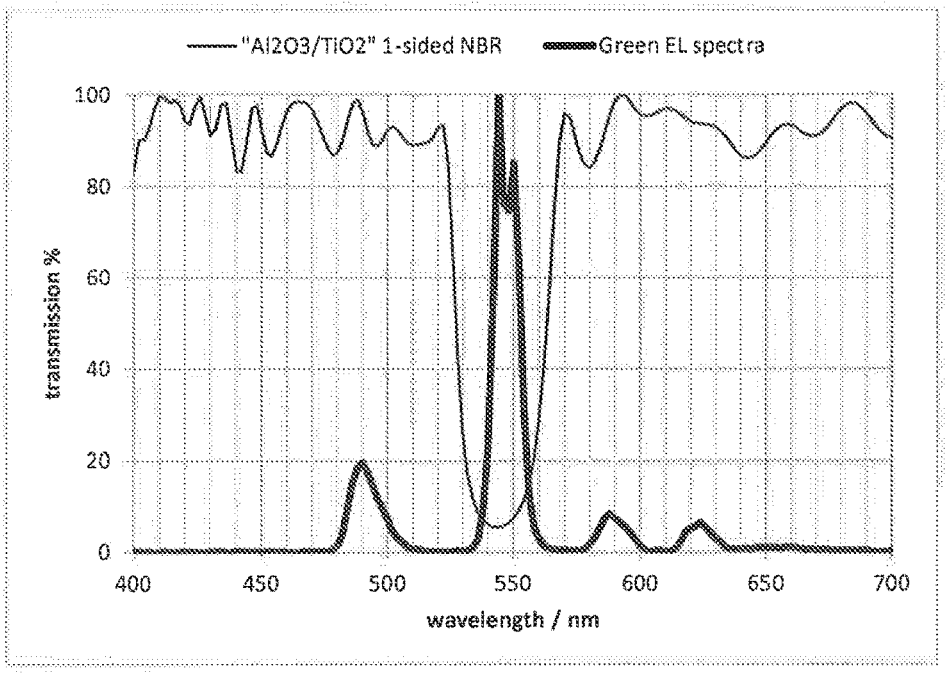

FIG. 15B demonstrates results related to an NBR constructed for a green TASEL. Structure in question is "4.062L 3.201H 0.284L 3.149H 1.62L 2.555H 0.32L 0.302H 0.436L 2.944H 2.011L 0.456H 0.429L 0.686H 1.788L 2.479H 2.033L 0.285H 0.559L 3.597H 0.179L 1.658H 0.324L 0.395H 0.321L 2.431H 1.664L 2.119H 0.064L 0.51H 0.19L 1.9H 1.856L 1.805H 1.668L 1.819H 1.782L 1.783H 0.927S". Materials are: L is $Al_2O_3$, H is $TiO_2$ and S is $SiO_2$, with substrate as BK7 (in optical design). Photopic transmission is about 79% and electroluminescent reflectance $R_{EL}$ for a green emission spectrum shown in FIG. 15B is 64%.

Figure 16A:
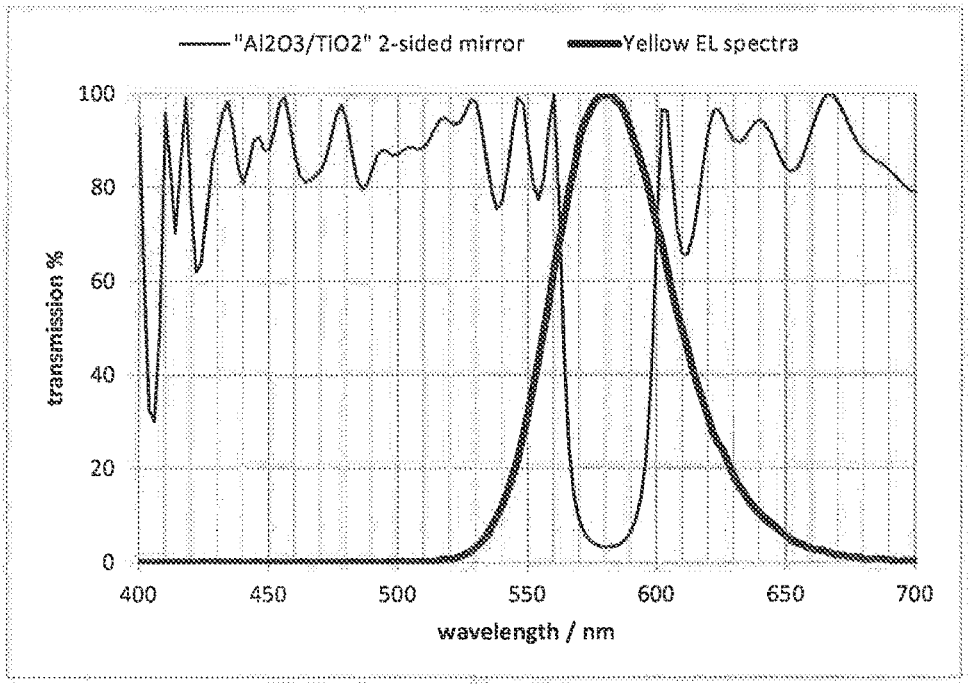
FIG. 16A shows optical properties of a 2-sided NBR designed for a transparent, yellow ZnS:Mn TASEL display.

FIG. 16A demonstrates, as an example, a two-sided NBR transmission characteristics designed for a transparent, yellow ZnS:Mn TASEL display.

FIGS. 16B-17B show the performance of a practical TASEL structure. In FIGS. 16B-17B, yellow emission spectrum is shown for reference with a thick line, and this yellow emission spectrum is also used for determining the electroluminescent transmission $T_{EL}$ and the related electroluminescent reflectance $R_{EL}$.

Figure 16B:
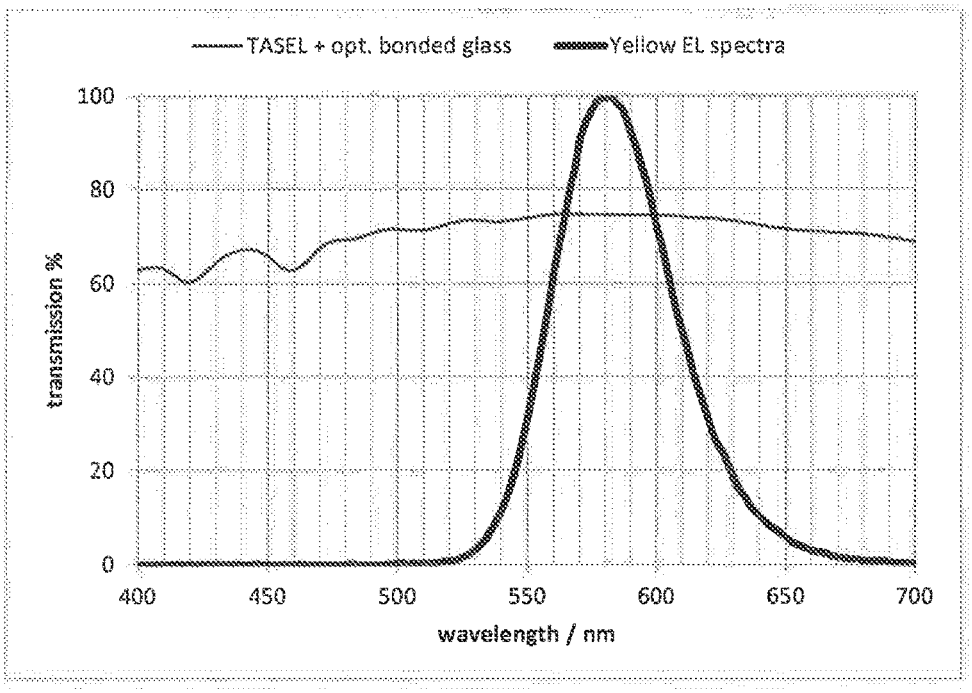
FIG. 16B shows optical properties related to a TFEL glass substrate with an active layer onto which an encapsulating glass sheet is bonded with a suitable adhesive.

FIG. 16B shows transmission results related to a TASEL glass substrate with an active layer onto which an encapsulating glass sheet is bonded with a suitable adhesive. In the structure related to FIG. 16B, there is no NBR present, and the transmission is relatively flat over the entire shown wavelength range of 400 nm-700 nm. Due to different material interfaces causing multiple reflections and other non-idealities, the radiometric transmission of the overall TASEL structure is in the order or 60%-75% over the entire shown wavelength range.

Figure 17A:
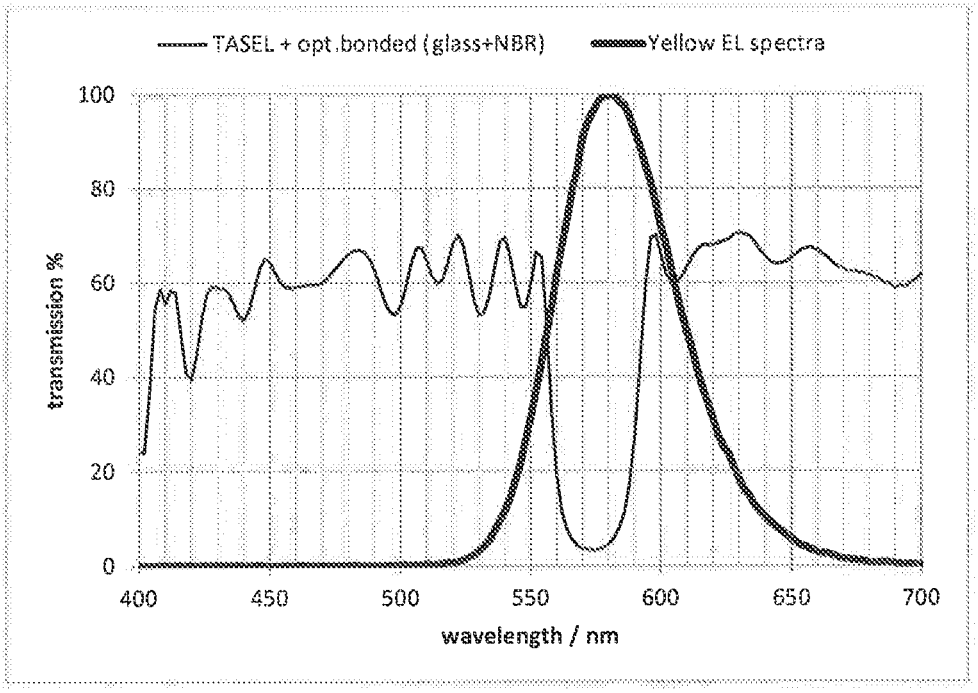
FIG. 17A shows transmission results related to a structure where an NBR with a structure related to FIG. 16A is directly optically bonded to an active layer of a TASEL display according to the present invention.

FIG. 17A shows transmission results related to a structure where an NBR with a structure with characteristics as shown in FIG. 16A is directly optically bonded to an active layer of a TASEL display so that the NBR and the viewing side surface are on the opposite sides of the active layer. The NBR causes the overall structure to be non-transparent, indicated by low radiometric transmission values at wavelengths between approximately 560 nm and 590 nm, leading to a high electroluminescent reflectance, $R_{EL}$, as the yellow active layer is predominantly active in these wavelengths.

Figure 17B:
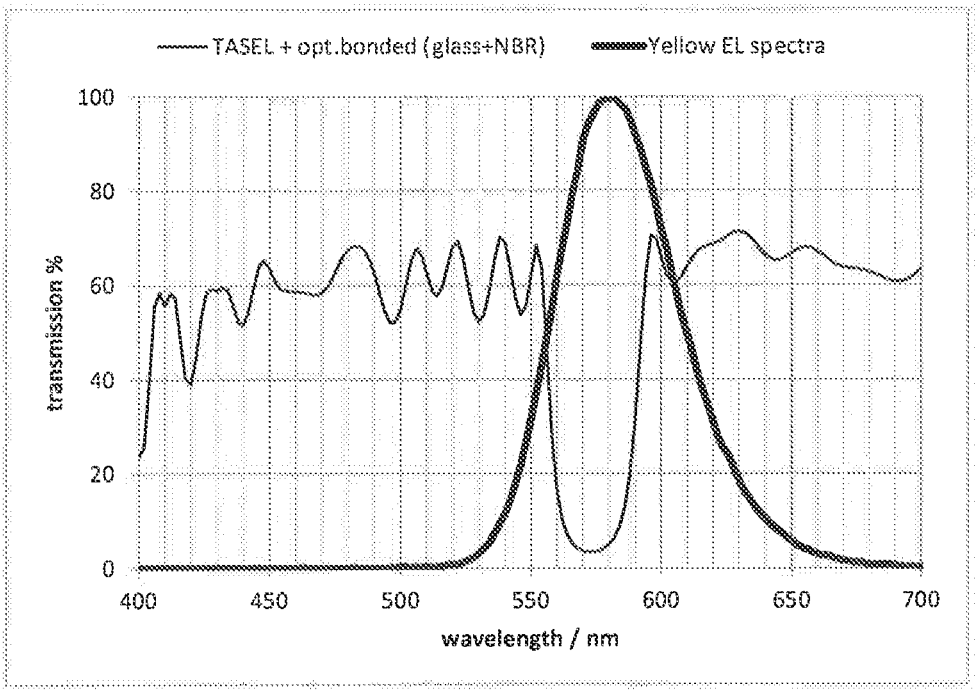
FIG. 17B shows results related to a structure where an NBR with a structure related to FIG. 16A is bonded with a TASEL subunit comprising a glass sheet over the active layer according to the present invention.

FIG. 17B shows results related to a structure where an NBR with a structure related to FIG. 16A is bonded with an adhesive with a TASEL subunit is comprising a glass sheet over the active layer so that NBR and viewing side surface are on the opposite sides of the active layer.

Both structures, as characterized in FIG. 17A and as in 17B, perform very well for practical purposes. As results in FIGS. 17A and 17B are also very close to each other, it can be concluded that the optical bonding related to glass sheets do not interfere noticeably with the operation of the TASEL display.

By measuring the structure related to FIG. 17A or FIG. 17B, it can be concluded that 206 nits of EL light is generated towards the viewer, form the viewing side surface. In the structure of 16B, 154 nits is generated. By measuring the photopic transmission of structures related to 16B, 17A and 17B the results are as follows: Structure of 16B, $T_P$=71%, structure of 17A, $T_P$=54% and structure of 17B, $T_P$=54%. In line with the present invention, structures related to FIGS. 17A and 17B (with an NBR) decrease the photopic transmission value, and consequently, ambient light through the display, by 24% (=(71%−54%)/71%). In other words, in structures related to FIGS. 17A and 17B, photopic transmission is 100%−24%=76% of the structure without the NBR as characterized by FIG. 16B.

To examine the effect of the NBR, an ambient light level must be set to some practical level. By using a typical value of $L_{AM}$=100 nits, contrast ratio for a structure with NBR (related to FIG. 17A or 17B) $CR_{NBR}$ is $CR_{NBR}=(206+0.76L_{AM})/0.76L_{AM}=3.71$, and without a NBR, denoted with $CR_0$, and related to FIG. 16B, $CR_0=(154+LA)/L_{AM}=2.54$. Thus, in structures (with an NBR) related to FIG. 17A or 17B the contrast ratio is 46% (=(3.71−2.54)/2.54) higher than in a structure related to FIG. 16B without an NBR. With similar reasoning, with a higher ambient luminance value of $L_{AM}$=500 nits, still an improvement of 18% is gained.

Figure 18:
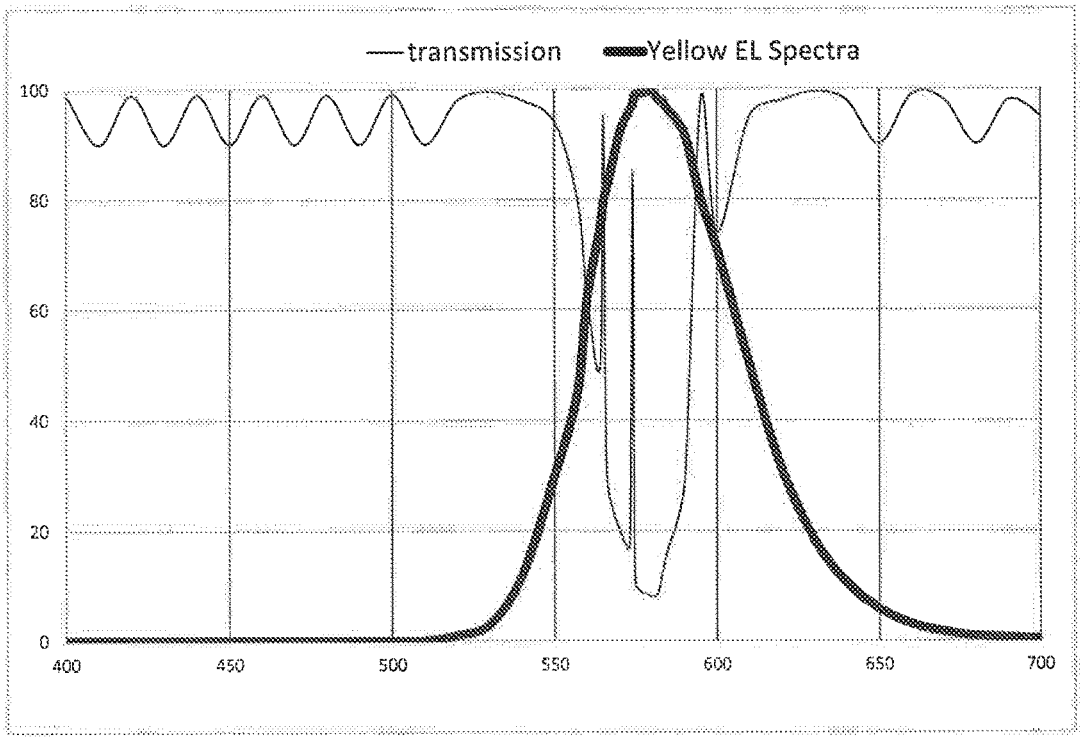
FIG. 18 illustrates how the radiometric transmission of a structure can have spikes in the areas of generally low transmission.

Finally, FIG. 18 shows an arbitrary transmission characteristics of a narrowband reflector which is designed to reflect in the wavelength region from 560 nm to 590 nm (corresponding approximately the emission wavelengths of the yellow EL display). The transmission curve has spikes of high transmission (e.g. at 565 nm and 575 nm wavelengths) indicating poor reflectivity at and in the vicinity of those wavelengths. However, as the spikes are narrow (concentrated around a very narrow band of wavelengths, 1 nm-3 nm), their overall effect into the electroluminescent transmission is small—the reflector still reflects most of the light emitted by the yellow EL denoted by the dotted line.

It is obvious to a person skilled in the art that, as the technology advances, the inventive concept can be implemented in various ways. The invention and its embodiments are not limited to the examples described above but may vary within the scope of the claims.

The invention claimed is:

1. A transparent thin film electroluminescent display comprising a substrate, an active layer capable of emitting an emission spectrum of light in a wavelength range of visible light, and a viewing side surface, a narrowband reflector, said narrowband reflector and the viewing side surface being on opposite sides of the active layer, said narrowband reflector reflecting part of an ambient light entering the display through a backside surface, wherein the narrowband reflector comprises at least one layer of high-reflective index material, and at least one layer of low refractive index material.

2. The transparent thin film electroluminescent display according to claim 1, wherein electroluminescent transmission of the narrowband reflector is from 50% to 65% for an emission spectrum emitted by the active layer.

3. The transparent thin film electroluminescent display according to claim 1, wherein electroluminescent transmission of the narrowband reflector is from 25% to 50% for an emission spectrum emitted by the active layer.

4. The transparent thin film electroluminescent display according to claim 1, wherein electroluminescent transmission of the narrowband reflector is from 0.1% to 25% for an emission spectrum emitted by the active layer.

5. The transparent thin film electroluminescent display according to claim 1, wherein photopic transmission of the transparent thin film electroluminescent display is more than 30%.

6. The transparent thin film electroluminescent display according to claim 1, wherein photopic transmission of the transparent thin film electroluminescent display is more than 65%.

7. The transparent thin film electroluminescent display according to claim 1, wherein photopic transmission of the transparent thin film electroluminescent display is more than 40%.

8. The transparent thin film electroluminescent display according to claim 1, wherein the high refractive index material comprises titanium (Ti), and the low refractive index material comprises aluminium (Al) or zinc (Zn).

9. The transparent thin film electroluminescent display according to claim 1, wherein the high refractive index material comprises zinc (Zn), and the low refractive index material comprises aluminium (Al).

10. The transparent thin film electroluminescent display according to claim 1, wherein photopic transmission of the transparent thin film electroluminescent display is more than 50%.

11. A method for manufacturing a transparent thin film electroluminescent display having a viewing side surface, an active layer and a narrowband reflector, wherein the method comprises arranging the narrowband reflector—and the viewing side surface on the opposite sides of the active layer, and arranging the narrowband reflector comprising at least one layer of high refractive index material, and at least one layer of low refractive index material.

12. The method according to claim 11, wherein the method further comprises bonding the narrowband reflector to the active layer—with an adhesive of an adhesive layer.

13. The method according to claim 11, wherein the method further comprises optically bonding a narrowband reflector subunit directly to an encapsulated TASEL subunit.

14. The method according to claim 11, wherein the method further comprises bonding the narrowband reflector to a transparent sheet of an encapsulated TASEL subunit of a display of the TASEL subunit, the TASEL subunit comprising a substrate with the viewing side surface, the active layer, the thin film structure adhesive layer and a transparent sheet for encapsulation.

15. The method according to claim 11, wherein the method further comprises arranging an active layer on the narrow band reflector subunit comprising the narrow band reflector on a substrate for making a combined TASEL subunit comprising both the active layer and the narrow band reflector.

16. The method according to claim 11, wherein the method further comprises subjecting at least one layer of the narrowband reflector under manufacture, or at least one layer of the active layer under manufacture, or at least one layer of the luminescent layer under manufacture, to alternating surface reactions of at least a first and a second gaseous precursors.

17. The method according to claim 11, wherein the method further comprises arranging the narrow band reflector directly on the active layer of a transparent thin film electroluminescent display subunit (TASEL subunit) comprising the active layer on a substrate with the viewing side surface.

* * * * *